US009453704B2

(12) United States Patent
Bickert et al.

(10) Patent No.: US 9,453,704 B2
(45) Date of Patent: Sep. 27, 2016

(54) CONCEALED HOLSTER

(71) Applicant: Femme Fatale Holsters, LLC, Flower Mound, TX (US)

(72) Inventors: Jon Bickert, Flower Mound, TX (US); Donna Bickert, Flower Mound, TX (US)

(73) Assignee: Femme Fatale Holsters, LLC, Flower Mound, TX (US)

( * ) Notice: Subject to any disclaimer, the term of this patent is extended or adjusted under 35 U.S.C. 154(b) by 0 days.

(21) Appl. No.: 14/182,241

(22) Filed: Feb. 17, 2014

(65) Prior Publication Data

US 2014/0158734 A1 Jun. 12, 2014

Related U.S. Application Data

(60) Provisional application No. 61/824,360, filed on May 16, 2013.

(51) Int. Cl.
*F41C 33/02* (2006.01)
*F41C 33/04* (2006.01)

(52) U.S. Cl.
CPC ..... *F41C 33/048* (2013.01); *Y10S 224/911* (2013.01)

(58) Field of Classification Search
CPC ..... F41C 33/048; F41C 33/00; F41C 33/02; F41C 33/0209; F41C 33/0227; F41C 33/046; F41C 33/041; F41C 33/04; F41C 33/0218; Y10S 224/911
USPC ..... 224/911, 587, 222, 907, 660; D3/222
See application file for complete search history.

(56) References Cited

U.S. PATENT DOCUMENTS

| | | | | | |
|---|---|---|---|---|---|
| 944,355 | A * | 12/1909 | Beasley | 224/191 |
| 4,029,242 | A * | 6/1977 | Stoesser | 224/222 |
| 4,044,929 | A * | 8/1977 | Caruso | 224/676 |
| 4,410,118 | A * | 10/1983 | Taurisano | 224/222 |
| 4,475,675 | A * | 10/1984 | Miles | 224/191 |
| 4,579,265 | A * | 4/1986 | Schiller | 224/682 |
| 5,058,788 | A * | 10/1991 | Newmark | 224/222 |
| 5,148,949 | A * | 9/1992 | Luca | 222/175 |
| 5,215,238 | A * | 6/1993 | Baruch | 224/243 |
| 5,873,768 | A * | 2/1999 | Fleischman-Ament et al. | 450/19 |
| 5,894,976 | A * | 4/1999 | Harper | 224/587 |
| D657,951 | S * | 4/2012 | Davis et al. | D3/222 |
| D658,364 | S * | 5/2012 | Davis et al. | D3/222 |
| 2006/0196907 | A1* | 9/2006 | Pruitt | 224/587 |
| 2007/0102461 | A1* | 5/2007 | Carstens | 224/222 |
| 2008/0188889 | A1* | 8/2008 | Dedo | 606/203 |
| 2008/0229485 | A1* | 9/2008 | Cooper | 2/306 |
| 2010/0050312 | A1* | 3/2010 | French et al. | 2/69 |
| 2011/0220698 | A1* | 9/2011 | Tuggle | A45F 3/14 224/587 |
| 2011/0226825 | A1* | 9/2011 | Sanford | 224/243 |
| 2012/0073046 | A1* | 3/2012 | Inge | 5/420 |

* cited by examiner

*Primary Examiner* — Justin Larson
*Assistant Examiner* — Scott McNurlen

(57) ABSTRACT

An apparatus for selectively securing a weapon about the torso of a human comprises a base layer comprising a band of elastic configured to be disposed about the torso, a closure mechanism configured to retain the base layer about the torso and couple the first end to the second end, and a pocket comprising a padding layer coupled to the base layer on three sides. The base layer comprises a first end and a second end, and the base layer has a substantially uniform width about the torso when the closure mechanism couples the first end to the second end. The pocket has a width that is less than or equal to the width of the base layer.

30 Claims, 15 Drawing Sheets

CONCEALED HOLSTER

CROSS-REFERENCE TO RELATED APPLICATIONS

This application claims the benefit of and priority to U.S. Provisional Patent Application No. 61/824,360, filed May 16, 2013, entitled "Concealed Holster," which is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Weapons such as handguns have been attached to various parts of the human body and have generally been positioned to be readily removed by the wearer. For example, law enforcement officers and military personnel may carry handguns or other weapons in a position that allows the weapons to be readily accessed and drawn. In general, a weapon that can be readily removed would be visible on the user.

In some instances, users may carry weapons such as handguns in a concealed manner for a variety of reasons such as personal protection. The weapon may be concealed to hide the presence of the weapon from outside observers such as an attacker. In some locations, the right to carry a weapon is premised on being able to conceal that weapon so that another person cannot detect the weapon on the user. This would generally include directly viewing the weapon as well as being able to detect the outline or presence of a weapon through additional clothing.

SUMMARY

In an embodiment, an apparatus for selectively securing a weapon about the torso of a human comprises a base layer comprising a band of elastic configured to be disposed about the torso, a closure mechanism configured to retain the base layer about the torso and couple the first end to the second end, and a pocket comprising a padding layer coupled to the base layer on three sides. The base layer comprises a first end and a second end, and the base layer has a substantially uniform width between the first end and the second end. The pocket has a width that is less than or equal to the width of the base layer.

In an embodiment, an apparatus for selectively securing a weapon about a leg of a human comprises a base layer comprising a band of elastic configured to be disposed about the leg, a pocket comprising a layer of fabric coupled to the base layer on three sides, and an outer lace layer disposed over the base layer and pocket. The base layer comprises a continuous loop about the leg.

In an embodiment, a method of carrying a weapon comprises retaining a corset holster about a body of a user using tension, disposing a handgun within the pocket, and retaining the handgun within the pocket based on the tension of the corset. The corset comprises a base layer comprising a band of elastic configured to be disposed about a torso of the body, a closure mechanism configured to retain the base layer about the torso, and a pocket comprising a padding layer coupled to the base layer on three sides.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
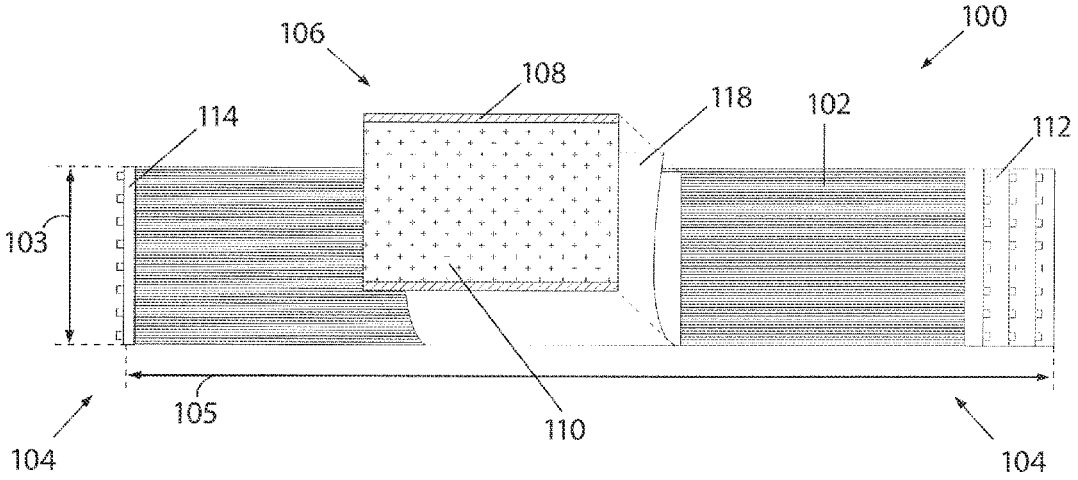
FIG. 1 illustrates a schematic layout of an embodiment of a corset holster.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

This disclosure generally relates to an apparatus (e.g., a holster) for securing a weapon on the person so that it may be concealed from view in use. The holsters are generally designed to be worn around a portion of the body of the user. For example, the holster can be worn around the torso, a leg, or an ankle of the user. In each case, the holster can be constructed of a material that stretches when placed on the user, which creates tension in the holster during use. In some embodiments, the material can have a uniform width and thereby create a relatively uniform tension along the width of the holster. The holster includes a pocket for holding a weapon or any variety of additional items in a concealed manner. The tension in the holster may provide a force on the pocket, which may also be formed of a stretchable material. The tension may then apply a closure force to any item in the pocket and retain the item within the pocket.

When the holster is designed to be worn about the torso of a user, it may be referred to as a corset holster. The corset holster can be constructed with a substantially uniform width that is wide enough to prevent the holster from rolling during use. For example, the corset holster can include a relatively uniform elastic construction (e.g., formed from a corset elastic) and have a width of at least about 4 inches, thereby providing a structure base that may limit or prevent the corset holster from rolling when worn on the torso of a user. The corset holster can include a closure mechanism to allow the corset holster to be placed on the torso and removed when desired. A pocket can be formed on the front of the base layer that may include padding to hide or help break up the outline of an item such as a weapon placed in the pocket. The uniform width and elastic construction may provide a tension about the torso of the user that may maintain the item within the pocket when worn. In some embodiments, various finishing layers can be included that both add to the aesthetic impression of the corset holster as well as reduce the friction with any outer clothing layers. When worn under an outer clothing layer, the corset holster may allow a weapon or item to be carried on the user in a concealed manner.

When the holster is designed to be worn about a leg of the user, it may be referred to as a thigh holster. Similar to the corset holster, the thigh holster can be constructed with a substantially uniform width that is wide enough to prevent the holster from rolling during use. A pocket can be formed on the base layer to retain various items. The thigh holster may be formed as a continuous loop of material, for example by stitching, sewing, or otherwise coupling the ends of the base layer together. The thigh holster can then be slipped on the leg and pulled into position. The uniform width and elastic construction may provide a tension about the leg of the user that may maintain the item within the pocket when worn. In some embodiments, additional support structures such as a garter belt can be used to maintain the thigh holster in position. When worn under an outer clothing layer, the thigh holster may allow a weapon or item to be carried on the user in a concealed manner.

When the holster is designed to be worn about an ankle of the user, it may be referred to as an ankle holster. Similar to the corset and thigh holsters, the ankle holster can be constructed with a substantially uniform width. In order to prevent discomfort to the user, a structural material may be used in a pocket piece to prevent pressure points on the ankle from items within the pocket. The ankle holster may be formed as a continuous loop of material, and the ankle holster can then be slipped on the foot and pulled into position about the ankle. The uniform width and elastic construction may provide a tension about the leg of the user that may maintain the item within the pocket when worn.

Each of the holster designs may include additional options. For example, a layer of silicon can be applied as a strip or coating on an interior surface of the holster to further limit the holster from moving when worn against the skin. The use of a relatively uniform elastic construction and/or uniform width may allow the holsters to be used to retain relatively heavy items within the pocket without movement about the body. Further, the tension in the base layer and pocket may help to hide the weapon in use. As a result, the holster may serve to provide a concealable storage location for a weapon or other item.

As shown in FIG. 1, a holster 100 for selectively securing a weapon about a torso of a person comprises a base layer 102 configured to be disposed about the torso, a closure mechanism 104 coupled to each end of the base layer 102 and a pocket formed 106 on the base layer 102. The base layer 102 comprises a woven fabric that can extend between the two ends. The width 103 of the base layer 102 can be substantially uniform between the two ends, where the width 103 refers to the vertical dimension of the holster 100 when worn by the user. A stretchable fabric 108 can be attached to the base layer 102 on the bottom and both sides (e.g., at or near the lateral edges) to form a pocket 106 having an opening at the top. The stretchable fabric 108 can be a padding layer or a separate padding layer 110 can be attached to the pocket 106 to aid in hiding the outline of a weapon or other item placed in the pocket 106. The holster 100 can be secured around the torso of the user by joining the closure mechanism 104 on each end of the base layer 102.

The base layer 102 can comprise a number of materials. In general, the holster 100 is maintained about the torso of the user based on tension, allowing for any stretchable fabric or material to be used for the base layer 102. In an embodiment, the base layer comprises an elastic fabric, for example, corset elastic. Corset elastic may comprise a single-weft elastic braid that can be provided in various weaves. The corset elastic can comprise from about 50% to about 90% fabric with the balance being a stretchable elastomer to provide an overall stretchability to the material. The fabric component can comprise a natural (e.g., cotton, silk, wool, etc.) or artificial fiber (e.g., nylon, polyester, etc.), and the elastomer can comprise any type of stretchable material such as rubber (natural or synthetic) or the like. In an embodiment, the corset elastic comprises about 70% polyester and about 30% rubber. The base layer 102 has a thickness selected to provide some amount of stiffness to allow the holster 100 to resist rolling when worn on the user. For example, a base layer 102 comprising corset elastic can comprise a garment or lingerie quality and thickness that is designed to resist rolling when worn by the user.

While described in some embodiments as comprising corset elastic, the base layer 102 can also comprise additional stretchable fabrics. In an embodiment, the base layer 102 comprises a stretchable material such as spandex (e.g., Lycra), a moisture-wicking fabric (e.g., a polyester microfiber blend), neoprene, or the like. The construction of the holster 100 may be the same regardless of the type of stretchable material used for the base layer 102. Using various materials can allow the overall look and feel of the holster 100 to be tailored to a variety of uses. For example, a holster 100 having a base layer 102 and/or pocket 106 formed from spandex may allow the holster 100 to be used during exercise or other physical activity (e.g., jogging, biking, working out, aerobics, etc.).

The base layer 102 can have a length 105 that is selected based on the size of the user. As used herein, the length 105 generally refers to the dimension of the holster 100 extending circumferentially around the body of the user when worn by the user. The width 103 of the base layer 102 can be selected based on the desired width of the pocket 106. For example, the width 103 of the base layer 102 can vary to account for the size of the items (e.g., a weapon such as a handgun, accessory, mobile phone, etc.) to be placed and/or concealed within the pocket 106. The width 103 of the base layer 102 can also be selected to aid in resisting rolling of the holster 100 when worn by the user. In an embodiment, the base layer 102 may be at least about 4 inches, at least about 5 inches, at least about 6 inches, or at least about 7 inches wide. In general, the base layer 102 may be less than about 10 inches, or alternatively less than about 9 inches to account for the expected location at which the holster 100 may be worn about the body. In some embodiments, the width of the base layer 102 may be substantially uniform between the ends.

A closure mechanism 104 comprising a first attachment member 112 and a second attachment member 114 coupled to respective ends of the base layer 102 can be used to secure the holster 100 about the torso of the user. The first and second attachment members 112, 114 can be selectively engaged to provide a retaining force for the holster 100. Various types of closure mechanisms can be used including, but not limited to, hook and loop type connectors (e.g., Velcro), buckles, buttons, and the like. In some embodiments, a holster 100 design may be used with grommets and a string to form a lace-up closure.

The use of some closure mechanisms 104 can result in an unfinished edge or other rough surface that can irritate the user's skin while wearing the holster 100. In order to reduce the potential for irritation, the closure mechanism 104 may comprise a lingerie closure. In this embodiment, the first attachment member 112 may comprise one or more rows of eyelets. For example, the first attachment member 112 can comprise one, two, three, four, or more rows of eyelets. Each row of eyelets can comprise a plurality of eyelets, for example, each row of eyelets can comprise between about 2 and 30 eyelets, alternatively between about 4 and 20 eyelets. The second attachment structure 114 can comprise a row of hooks configured to engage one of the rows of eyelets. The number of hooks can correspond to the number of eyelets in each row and have a corresponding spacing. The plurality of rows of eyelets allows for a selective adjustment to the size and tension of the holster 100 when the hooks are engaged with one of the rows of eyelets. A portion of the fabric may extend from beyond the first attachment structure 112 to provide a smooth layer between the closure mechanism 104 and the skin of the user to help reduce any undesired irritation to the user.

The pocket 106 can be formed by stitching a fabric or material layer forming an outer pocket assembly on the front of the base layer 102. The material can be stitched on the bottom, left, and right sides (e.g., edges) to form a pocket 106 having an opening at the top. As used herein, stitching a side of the material may generally refer to stitching along an edge of the component. The material can be stitched at or near one or more of the edges. The material can having a width that matches the width 103 of the base layer 102, thereby creating a pocket 106 extending substantially the width 103 of the base layer 102. The length of the pocket 106 can be selected to provide a pocket suitable for holding a desired handgun or other item. By creating the pocket 106 in this fashion, the pocket 106 can accommodate a variety of guns or items rather than being gun or item specific. In an embodiment, the length of the pocket 106 can be between about 2 inches and about 12 inches, or between about 4 inches and about 9 inches. Further, pockets that are larger or smaller can be constructed to accommodate larger or smaller guns and/or additional items (ammunition clips, money, identification, wallets, cell phones, etc.). In some embodiments, a plurality of pockets 106, which may have the same or different lengths and widths, can be formed along the length 105 of the base layer 102.

The material forming the pocket 106 can be selected to at least partially conceal or hide any item placed within the pocket 106. In an embodiment, the material forming the pocket 106 can include at least one layer of padding 110. The padding 110 generally serves to break up an outline and/or change a shape or the appearance of the shape of an item within the pocket 106. While referred to as padding 110 or the padding layer herein, other materials may serve to break up the outline of an item or change the shape or appearance of an item within the pocket 106 without necessarily serving a padding function. The padding 110 can include a number of materials including bra padding, neoprene, and the like. The padding 110 can be present as a single layer or a plurality of layers depending on the amount of material needed to hide the outline of the item in the pocket 106. For example, the pocket 106 can be formed from two layers of bra padding that are stitched to the base layer 102 to form the pocket 106 having the opening at the top. In an embodiment, the padding 110 may comprise a folded piece of padding 110. For example, a single piece of padding can be folded in half and stitched to the base layer 102 to form the pocket 106.

In an embodiment, the pocket 106 may also comprise a layer of stretchable fabric 108 along with one or more layers of padding 110. The stretchable fabric 108 can comprise any of those fabrics described with respect to the base layer 102. The stretchable fabric 108 used in the construction of the outer portion of the pocket 106 can comprise the same material as the base layer 102 or a different material. The use of the same material for the base layer 102 and stretchable fabric 108 may allow for a uniform elastic construction of the holster 100, which may also have a uniform width 103. In an embodiment, the stretchable fabric 108 used to create the pocket 106 can comprise corset elastic. The stretchable fabric 108 can be disposed between the padding 110 and the base layer 102, and/or the stretchable fabric 108 can be disposed on the outer surface of the padding 110. The stretchable nature of the stretchable fabric 108 as well as the base layer 102 may create tension across the pocket 106 when an item such as a gun is placed within the pocket 106. The tension may create friction with the gun placed in the pocket 106, aiding in retaining the gun within the pocket 106 during use.

The pocket 106 can optionally include one or more additional layers. In some embodiments, the pocket can include one or more layers of a moisture barrier 118 to help prevent moisture, perspiration, and/or body oils from the user from reaching the contents of the pocket 106. The moisture barrier 118 may comprise a material that is resistant to liquid water while allowing gases (e.g., air, water vapor, etc.) to pass through. The waterproof yet breathable fabric is generally referred to as a water resistant fabric. In an embodiment, the moisture barrier 118 can comprise a material formed from a polyester/polyurethane laminate (PUL). While the lining can be described in some cases as being constructed from PUL, additional water resistant materials may also be used to form the water resistant lining. For example, the moisture barrier 118 may comprise a material that is substantially impermeable to liquids and gases.

The moisture barrier 118 can be included as one or more layers forming the pocket 106. In an embodiment, the moisture barrier 118 can be used to line the pocket 106 with a layer being connected to the base layer 102 as well as a layer being connected to the stretchable fabric 108. For example, a single piece of the material forming the moisture barrier 118 can be folded in half and stitched to the sides and/or the bottom of the pocket, thereby lining the pocket 106 with an opening at the top. In some embodiments, the moisture barrier 118 may only be present between the interior of the pocket 106 and the torso of the user. For example, the moisture barrier 118 may be coupled to one or more sides of the base layer 102 to prevent or limit perspiration or oils from the user from reaching the contents of the pocket 106.

Figure 2A:
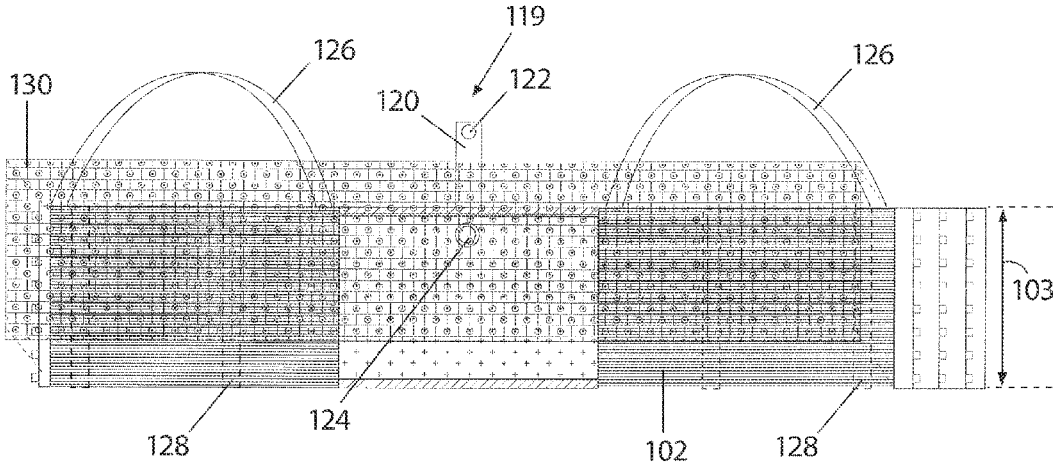
FIG. 2A illustrates another schematic layout of an embodiment of a corset holster.

The base layer 102 can optionally include support structures at one or more points along its length 105 to provide additional stiffness and resistance to rolling during use. In an embodiment as shown in FIG. 2A, the support structures can include boning 128 coupled to or incorporated into the base layer 102. As used herein, boning 128 refers to the use of one or more rigid components coupled to the fabric to support the fabric and retain a desired shape. The boning 128 generally introduces strain into the fabric to resist movement of the fabric when worn. The boning 128 is generally relatively flat and allows for movement or bending along its flat sides, but resists compression lengthwise. In an embodiment, the boning 128 may be used along the width 103 (e.g., vertical direction) of the base layer 102 at one or more points to retain the width 103 of the holster 100 when worn. The boning 128 can include relatively flat stays formed from one or more materials coupled to the base layer 102 and/or inserted into a channel within the base layer 102. Various materials useful for forming boning 128 can include plastic (e.g., nylon) and/or metal.

In some embodiments as shown in FIG. 2A, an optional finish layer 130 can be disposed over the base layer 102 and outer pocket assembly. For example, a material layer can be disposed over the outer surface of the holster 100 to provide a finished appearance, limit friction between the holster 100 and any outer clothing layers, and/or to provide additional tension in the holster 100 during use. The finish layer 130 can be a solid layer or an open weave material (e.g., a lace). In an embodiment, the finish layer 130 can comprise a stretchable material such as stretch lace. A finish layer 130 that is stretchable may allow the finish layer 130 to be tensioned and stretch along with the base layer 102 and pocket 106 when worn by the user. The finish layer 130 may also have a relatively low coefficient of friction when contacted by outer clothing layers. The reduction in friction with any outer clothing layers may allow the holster 100 to slide relative to any outer clothing layers, thereby remaining concealed under various clothing types.

The optional finish layer 130 can have a width that is substantially the same as the width 103 of the base layer 102. In some embodiments, the finish layer 130 can be slightly wider than the width 103 of the base layer 102 to allow the base layer and pocket 106 to be entirely covered. The finish layer 130 can be attached at one or more points to the base layer 102 and/or the pocket 106, for example, stitched at the ends and/or along the top and/or bottom of the holster 100.

An optional pocket closure 119 may be used to secure the top opening of the pocket 106. In an embodiment, the pocket closure 119 may include a retention strap 120 that may be optionally used for securing the items in the pocket 106. The retention strap 120 may generally be connected to the base layer 102 or the outer pocket assembly (e.g., the padding 110 and/or the stretchable fabric 108). For example, the retention strap 120 may be stitched or otherwise connected to the base layer 102. A connection member 122 on the retention strap 120 can be configured to engage a corresponding coupling member 124 on the outer surface of the pocket 106 and provide a retention force. The retention strap 120 can have a length suitable to extend over an item placed in the pocket 106 to retain the item, for example a handgun, within the pocket 106 during use. In some embodiments, the retention strap 120 can have an adjustable length to allow different sized items to be placed in the pocket 106 and retained with the retention strap 120.

Additional pocket closures 119 may also be used. In an embodiment, the pocket closure 119 may comprise a hidden closure to secure the opening of the pocket 106. For example, a zipper may be placed across the top of the pocket 106 to allow money to be securely stored within the pocket 106. In some embodiments, a hook and loop type closure mechanism may be used to secure the opening of the pocket 106. A hidden closure may be useful to retain various valuables on the body of the user in a concealed manner when the holster 100 is designed for valuables that can fit completely within the pocket 106. For example, the holster 100 may be used to store money, a passport, credit cards, etc., and the hidden closure can be used to secure the opening of the pocket 106.

The holster 100 can be retained about the torso of a user based on tension within the holster 100. In some embodiments, additional support may optionally be provided using one or more support straps 126. In this embodiment, one or more optional support straps 126 such as shoulder straps can be used to support the holster 100 on the user. The shoulder straps can be connected to the base layer 102 at or near the pocket 106 and at or near the attachment members 112, 114. The support straps 126 can be configured to pass directly over the shoulders or cross in the front or back of the user. In some embodiments, a single support strap 126 can be used that can either pass straight back over one shoulder, or the single shoulder strap 126 can cross sides of the user's body in the front or the back of the neck (e.g., a cross-shoulder strap).

Figure 2B:
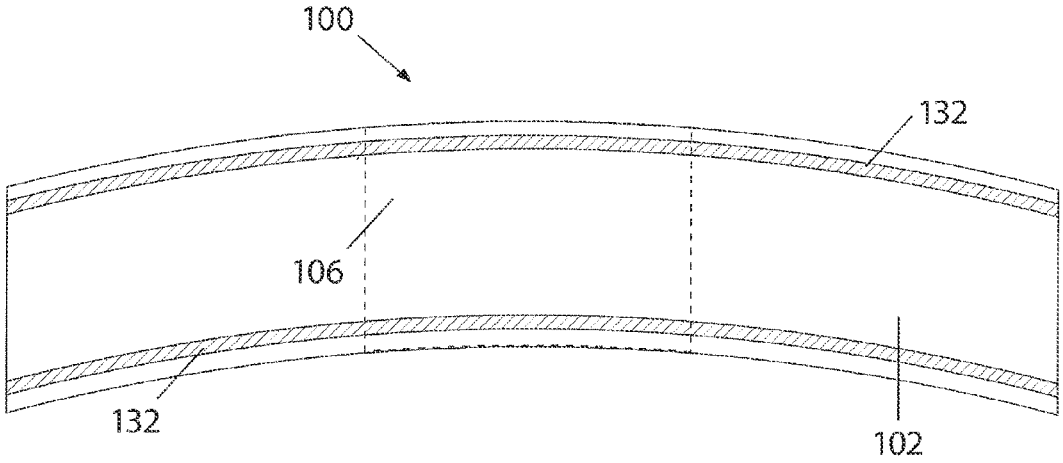
FIG. 2B illustrates a schematic perspective view of an embodiment of a corset holster.

The holster 100 may optionally include one or more strips 132 of a non-slip material disposed on an interior surface so that the non-slip strip 132 contacts the user when the holster 100 is worn. As shown in FIG. 2B, a non-slip strip 132 can be disposed on an interior surface of the base layer 102 (e.g., the surface opposite of the surface having the pocket 106 disposed thereon). The non-slip material can include a number of materials. In an embodiment, the non-slip strip(s) 132 can comprise a non-slip material layer disposed directly onto the base layer 102. Alternatively, the non-slip strip(s) 132 can be provided as a tape or ribbon that is adhered and/or stitched to the base layer 102. In some embodiments, a non-slip strip 132 can be formed by incorporating non-slip material into the base layer fabric, for example, by weaving the material into the base layer 102. In some embodiments, the non-slip strip 132 may comprise a layer applied to all or a portion of the base layer 102. The non-slip strip 132 can comprise a number of materials including, but not limited to, silicone, natural rubber, polymers, adhesives, and the like.

The various materials making up the holster can be selected to provide the look and feel of the holster 100 based on the customer preferences as well the intended use. For example, the materials can be provided in their natural colors, or any number of color combinations can be selected. For example, the materials can be selected to provide a variety of colors and/or color combinations including, but not limited to, nude, black, white, pink, red, or any combination thereof.

Referring to FIGS. 1 and 2A, the holster 100 can be constructed in various orders. In an embodiment, the pocket 106 can first be constructed by attaching an outer padding 110 layer onto the stretchable fabric 108. The padding 110 can be secured to the stretchable fabric 108 by stitching along one or more sides, and in an embodiment, the padding 110 can be stitched on all four sides to the stretchable fabric 108 to form the outer pocket assembly. When a moisture barrier 118 is used, a sheet of the moisture barrier 118 can be coupled to the top edge of the base layer 102 and the top, inner edge of the outer pocket assembly. A finish layer 130 (e.g., stretch lace) can then be attached to the top, outer edge of the outer pocket assembly. The outer pocket assembly can then be attached to the base layer 102 to form the pocket 106. For example, the outer pocket assembly can be stitched to the base layer 102 on both sides and the bottom. The finish layer 130 can then be attached to the top and bottom edges of the base layer 102 except for the portion attached to the top, outer edge of the outer pocket assembly. The finish layer 130 can be attached along the entire bottom length of the holster 100 to the base layer 102/pocket 106, along the top edge of the outer pocket assembly, and along the top edge of the base layer 102 that is not covered by the outer pocket assembly. The closure mechanisms 104 can then be attached to each end. For example, the one or more rows of eyelets can be attached to a first end of the base layer, and a row of hooks can be attached to a second end of the base layer. The optional pocket closure such as a retention strap 120 and/or one or more support straps 126 can then be attached to the holster 100.

Figure 3:
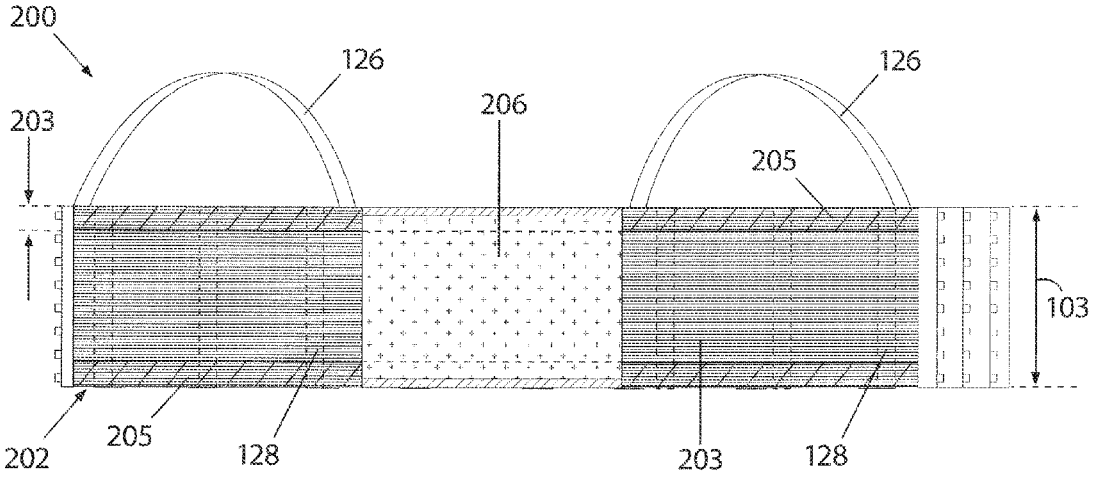
FIG. 3 illustrates another schematic layout of an embodiment of a lace corset holster.

The holster may also comprise additional designs. In an embodiment as shown in FIG. 3, the holster 200 may comprise a base layer 202 formed from a combination of materials. The base layer 202 may comprise a body formed of a first material 203, which may be a stretchable fabric. For example, the first material 203 can comprise an open weave material such as a lace material (e.g., a stretchable lace). The first material 203 may have width and length that is the same or similar to that of the base layer described above.

One or more strips of a second material 205 can be connected to the first material 203 along the top and/or bottom halves of the body. The second material 205 may comprise a stretchable fabric that has a greater dimensional stability than the first material 203. For example, the second material 205 can comprise any of the stretchable fabrics described above with respect to the base layer 203. In an embodiment, the second material 205 comprises a corset elastic. The second material 205 may aid in providing tension and rigidity in the holster 200 during use.

The second material 205 may be present as one or more strips having a width 103 within a range of about 5% to about 25%, alternatively about 7% to about 20% of the overall width 103 of the base layer 202. For example, the one or more strips may have a width 103 that falls within the range of about ¼ inch to about 1½ inches, or alternatively in a range of about 1 inch to about ½ inch. When multiple strips of the second material 205 are present, each strip may have the same or a different width 103. The second material 205 may be secured to the first material 203 at one or more points along its length. For example, the strips of the second material 205 may be stitched to the first material 203 along its entire length, though in some embodiments, the second material 205 may be coupled to the first material 203 over less than its entire length.

Boning 128 or other structural elements may be included in the holster 200 to provide additional support for the holster 200. The boning 128 may extend between strips of the second material 205 when a plurality of strips of the second material 205 are present. The boning 128 may extend at least partially around the holster 200 when it is present. Additional support elements such as one or more support straps 126 as described above may also be optionally used to support the holster 200 during use.

The pocket 206 of the holster 200 may comprise any of the pocket designs described above. In an embodiment, the pocket 206 can be formed from one or more layers of padding on the front and the first material on the back. The pocket 206 can also include a layer of stretchable material such as corset elastic coupled to the padding to form the front of the pocket 206. The pocket 206 can include the moisture barrier as a lining and/or one or more layers forming the pocket 206. An optional closure mechanism can be used to secure the top opening of the pocket 206.

Figure 4:
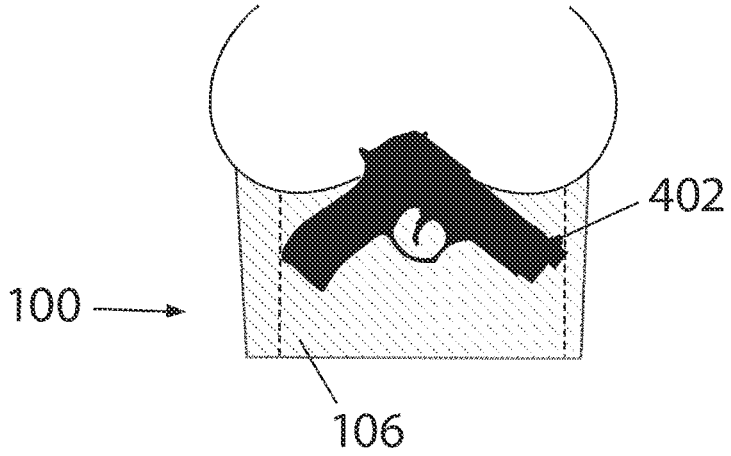
FIG. 4 illustrates an embodiment of the placement of a corset holster on a torso.

Referring to FIGS. 1, 2A, and 2B, the holster 100 can be placed around the torso and secured using the closure mechanism 104 during use. Depending on the type of closure mechanism 104 present, the holster 100 can be adjusted to provide a desired fit and tension based on the adjustability of the closure mechanism 104. For example, the lingerie closures comprising the hook and eye closures with multiple rows of eyes provides an adjustable fit depending on the row of eyes selected to engage the row of hooks. When worn on the body with the closure mechanism 104 engaged, the stretchable fabric forming the base layer 102 may create a tension about the torso of the user that holds the holster 100 in position on the body. The optional support straps 126 may also be used to provide a force to retain the holster 100 in position during use. The holster 100 may be designed to fit comfortably just below the bra line as shown in FIG. 4. In some embodiments, other positions about the torso can also be used. For example, the holster 100 can be worn lower on the waist, more like a traditional belly band. It can also be worn low on the hips for inside the waistband carry, for example in the back or on the hip. The holster 100 may also be worn with the pocket under the arm.

A weapon 402 such as a handgun may be disposed within the pocket 106. The handgun 402 may be positioned within the pocket 106 in any configuration, and a portion of the weapon 402 may extend out of the pocket 106. However, the majority of the weapon 402 may be within the pocket 106 and concealed by the front of the pocket 106. For example, a handgun may be positioned in the pocket 106 with the barrel and grip within the pocket 106. A portion of the handgun near the hammer and/or rear of the slide/frame may extend beyond the upper edge of the pocket 106 and thereby protrude out of the pocket 106. Other suitable positions of the weapon 402 in the pocket 106 may be used. For handguns, it is generally desired to position the gun in the pocket 106 to allow the weapon 402 to be drawn with the barrel pointed away from the torso/body of the user. In various positions, any portion of the handgun protruding from the pocket 106 may be concealed by other body parts and/or an outer layer of clothing. For example, when the pocket 106 is aligned under the bra line, a portion of the handgun protruding from the pocket may be concealed by a bra or the breasts of the user. Similarly, when the pocket 106 is aligned under an arm of the user, a portion of the handgun protruding from the pocket 106 may be concealed by the arm of the user. Still further, when the pocket 106 is disposed about the waist of the user, and outer shirt and/or pants may conceal a portion of the handgun protruding from the pocket 106. If an optional pocket closure 119 is present, the pocket closure 119 may be used to further retain the weapon 402 within the pocket 106. The outline of the weapon 402 may be broken up, masked, or otherwise hidden by the padding and lace. An outer garment such as a shirt may be placed over the holster 100 to further conceal the holster 100, the weapon 402 within the pocket 106, and a portion of the weapon 402 protruding from the pocket 106. The weapon 402 may then be carried by the user in the pocket 106 during normal daily activities without providing an outward indication of the presence of the weapon 402 on the user.

During use, the tension in the holster 100 resulting from the stretchability of the base layer 102 and/or outer pocket assembly can be used to retain the items such as a weapon 420 within the pocket 106. In general, the tension and stretching of the base layer 102 may create a tension between the sides of the pocket 106. The tension may then be present across the portion of the base layer 102 forming the back of the pocket 106 as well as across the entire face of the outer pocket assembly. When the outer pocket assembly comprises a stretchable material, the outer pocket assembly may also stretch when the holster 100 is worn to provide tension across the pocket 106. The tension across the pocket 106 can create a closure force on the pocket 106. When an item is disposed within the pocket 106, the tension and resulting closure force can aid in retaining the item within the pocket 106. For example, the contact of the pocket material with the item can create a friction force between the pocket material and the item, and the tension across the pocket 106 can increase this friction force. The selection of materials that are in contact with the items in the pocket 106 can be based, at least in part, on the amount of friction between the items in the pocket 106 and materials in contact with the item. The closure force can also cause the material at the top of the pocket 106 to be biased towards a closed position. This biasing force can aid in at least partially closing the pocket 106, which may partially close around the item such as the weapon 402 (e.g., a handgun).

The holster 100 described herein generally results in the formation of a pocket 106, which may be water resistant, that is concealed from view. While generally described as being designed to hold a weapon 402 such as a handgun, the concealed pocket design may be used to retain various types of valuables on the body of the user in a concealed manner. For example, the holster 100 may be used to store money, a passport, credit cards, mobile phone, etc. When designed for valuables that can fit completely within the pocket 106, the holster 100 may comprise a closure mechanism 119 to close the opening of the pocket 106. For example, a zipper may be placed across the top of the pocket 106 to allow money to be securely stored within the pocket 106.

Figure 5A:
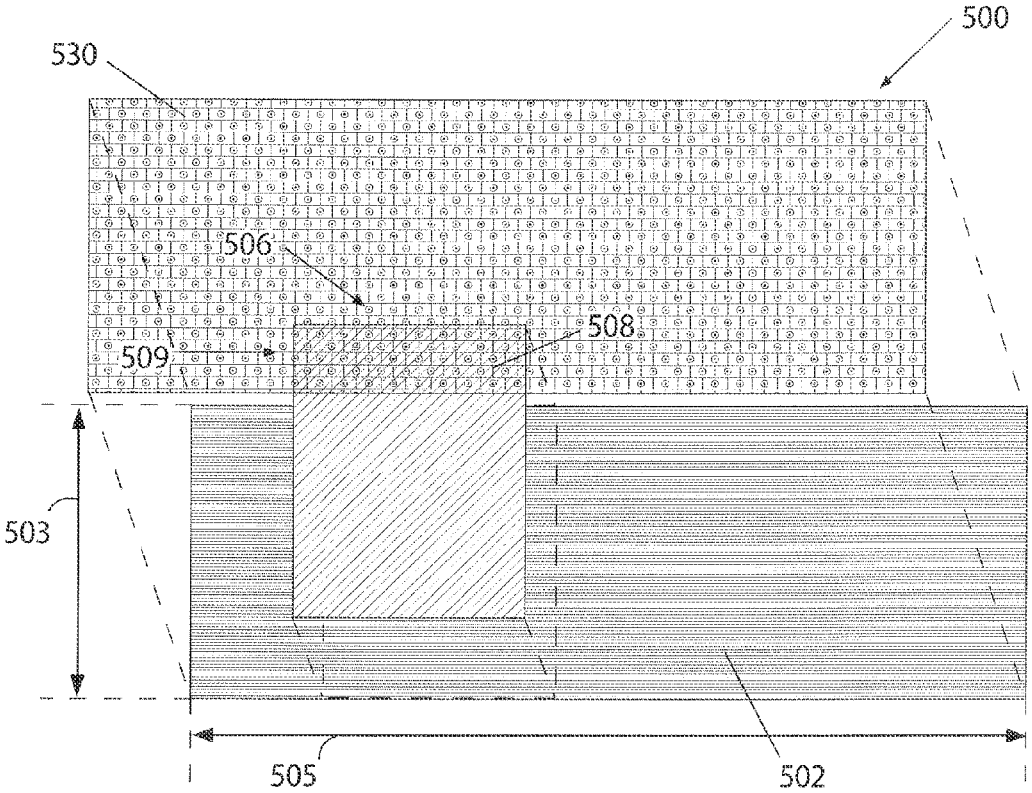
FIG. 5A illustrates a schematic layout of an embodiment of a thigh holster.
Figure 5B:
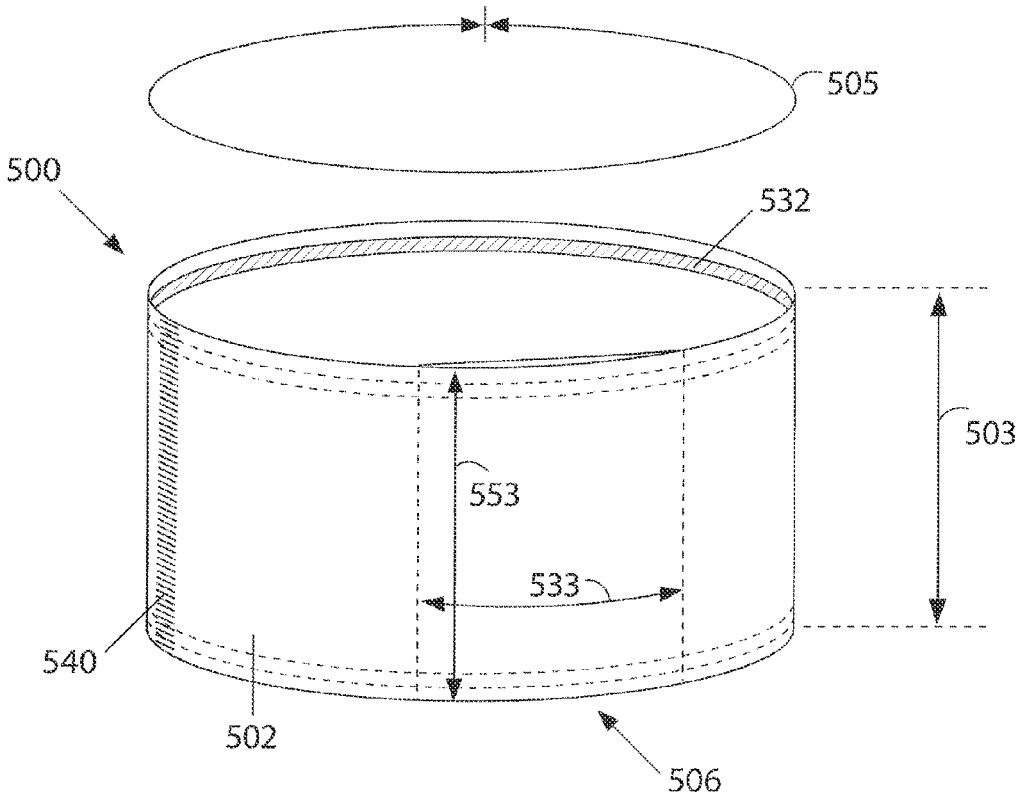
FIG. 5B illustrates a schematic perspective view of an embodiment of a thigh holster.

The holster described with respect to FIGS. 1-4 is described as being placed at various positions about the torso of a user. The holster designs described above can also be used to provide a holster having a pocket that can be disposed at various other locations on the human body. In an embodiment as shown in FIGS. 5A and 5B, a thigh holster 500 can be configured to selectively securing a weapon about a leg of a person. The thigh holster 500 can include a base layer 502 comprising a base layer 502 of stretchable material configured to be disposed about the leg and a pocket 506 comprising a layer of fabric coupled to the base layer 502 on three sides. The base layer 502 can be configured to provide a continuous layer about the leg (e.g., as shown in FIG. 5B). An optional finish layer 530 can be provided on the outside of the thigh holster 500.

The base layer 502 can comprise a number of materials. Similar to the holster described above with respect to FIG. 1, the thigh holster 500 may be maintained about the leg of the user based on tension, allowing for any stretchable fabric or material to be used for the base layer 502. In an embodiment, the base layer 502 comprises any of the stretchable materials described above. In an embodiment, the stretchable material forming the base layer 502 can include, but is not limited to, corset elastic or any of the other materials described above (e.g., spandex). The base layer 502 has a thickness selected to provide some amount of stiffness to allow the thigh holster 500 to resist rolling when worn on the user. For example, a base layer 502 comprising corset elastic can comprise a garment or lingerie quality and thickness that is designed to resist rolling when worn by the user.

The base layer 502 can have a length 505 that is selected based on the dimensions of the user's leg. As used herein, the length 505 of the thigh holster 500 generally refers to the dimension of the thigh holster 500 extending circumferentially around the leg of the user, and the width 503 refers to the dimension running along the axis of the leg (e.g., an axis parallel to a line running between the knee and hip). The length 505 and/or width 503 of the base layer 502 can be selected based on the desired length 555 and/or width 553 of the pocket 506. For example, the length 505 and/or width 503 of the base layer 502 can vary to account for the size of the items (e.g., a weapon such as a handgun, accessory, mobile phone, etc.) to be placed and/or concealed within the pocket 506. The width 503 of the base layer 502 can also be selected to aid in resisting rolling of the thigh holster 500 and allowing the thigh holster 500 to remain in position when worn by the user. In some embodiments, the width 503 of the base layer 502 may be uniform about its circumference. In an embodiment, the base layer 502 may be at least about 4 inches, at least about 5 inches, at least about 6 inches, or at least about 7 inches wide. In general, the base layer 502 may be less than about 10 inches, or alternatively less than about 9 inches wide to account for the expected location at which the thigh holster 500 may be worn about the leg. For example, the thigh holster 500 may generally be worn on the upper thigh above the knee.

The ends of the base layer 502 can be coupled together to form a continuous band or loop for the base layer 502 (e.g., as shown in FIG. 5B). Various connection methods can be used to create the connection 540 between the ends of the base layer 502. In an embodiment, the ends of the base layer 502 can be stitched together to form a single band of material. For example, the ends can be finished using a serger to create a flat seam that lies flat against the inner thigh. The use of a flat seam can avoid pressure points that can lead to discomfort for the user.

In an embodiment, one or more optional non-slip strips 532 can be applied to the inner side of the base layer 502 (e.g., the side facing and/or in contact with the body). In an embodiment, the non-slip strip 532 can be placed along the upper and/or lower edges to prevent slipping and movement along the leg. The non-slip material can include a number of materials including any of those described above, and the non-slip strip 532 can be incorporated into the thigh holster 500 using any of the methods described above. Some people can be allergic or react to silicone, rubber, polymers, and other non-slip materials. As a result, the non-slip strips 532 may not be included in some embodiments, and alternative retaining members or support structures can be used, as described in more detail herein.

The pocket 506 can be formed by stitching a pocket assembly 509 comprising a fabric or material layer on the front of the base layer 502. The pocket assembly 509 material can be stitched on the bottom, left, and right to form a pocket 506 having an opening at the top. The material can having a pocket width 553 that substantially matches the width 503 of the base layer 502, thereby creating a pocket extending substantially the width 503 of the base layer 502.

The length 555 of the pocket 506 can be selected to provide a pocket 506 suitable for holding a desired handgun or other item. By creating the pocket 506 in this fashion, the pocket 506 can accommodate a variety of weapons or items rather than being weapon or item specific. In an embodiment, the length 555 of the pocket 506 can be between about 2 inches and about 10 inches, or between about 3 inches and about 8 inches. Further, pockets 506 that are larger or smaller can be constructed to accommodate larger or smaller guns and/or additional items (ammunition clips, money, identification, wallets, cell phones, etc.).

In an embodiment, the fabric or material layer forming the outer pocket assembly 509 comprises a layer of stretchable fabric 508. The stretchable fabric 508 can comprise any of those fabrics described with respect to the base layer 502 and/or the base layer discussed with respect to FIG. 1 above (e.g., base layer 102). The stretchable fabric used to form the pocket 506 can comprise the same material as the base layer 502 or a different material. The use of the same material for the base layer 502 and stretchable fabric 508 may allow for a uniform elastic construction of the thigh holster 500. In an embodiment, the stretchable fabric 508 used to create the pocket 506 can comprise corset elastic. The stretchable nature of the stretchable fabric 508 as well as the base layer 502 may create tension across the pocket 506 when a handgun is placed within the pocket 506. The tension may create friction with the handgun placed in the pocket 506, aiding in retaining the handgun within the pocket 506 during use.

The location of the pocket 506 on the leg may not require that padding be present on the outside of the pocket 506. For example, the pocket 506 may generally be constructed so that the pocket 506 aligns along the inside of the leg. The arrangement of the connection (e.g. seam) 540 and pocket 506 can vary for either the left or right leg, so that the connection is on the inner thigh and the pocket 506 is in the correct position on the leg. In this position, the stretchable fabric 508 forming the outer pocket assembly 509 may be sufficient to retain the contents of the pocket 506 within the pocket 506 as well as break up an outline of the contents of the pocket 506 to some degree. However, in some embodiments, an optional layer of padding may be present between the contents of the pocket 506 and the exterior of the pocket and/or between the contents of the pocket 506 and the leg of the wearer. The padding can include a number of materials including bra padding, neoprene, and the like (e.g., any of the materials described with respect to the padding layer 110 of FIG. 1).

Figure 6:
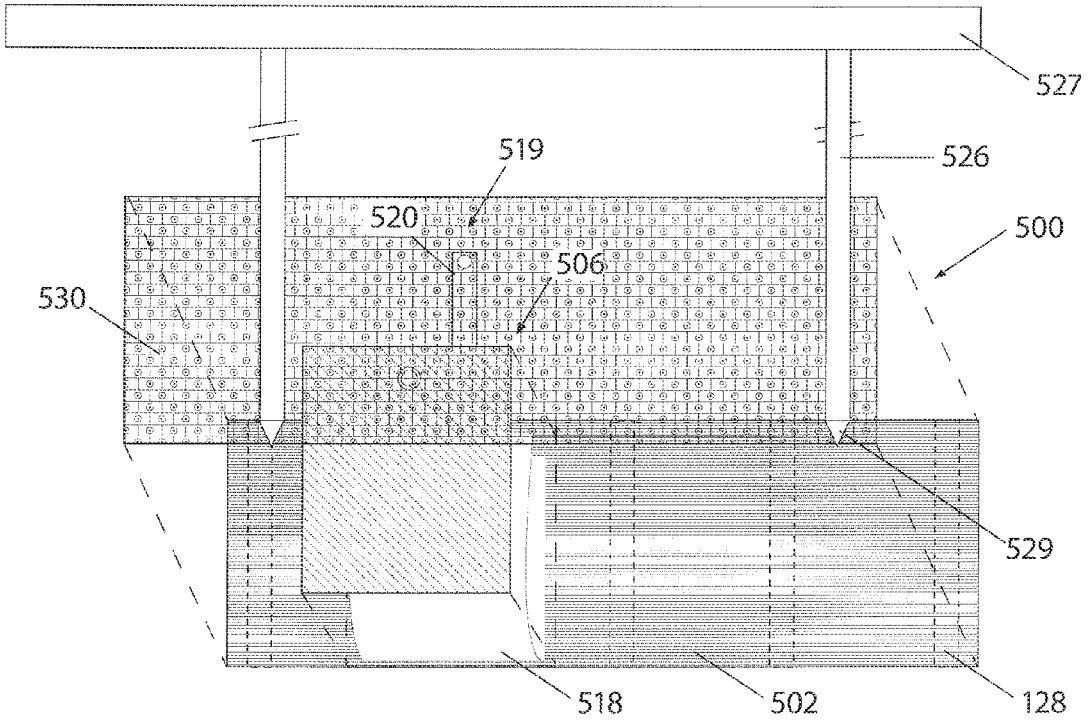
FIG. 6 illustrates another schematic layout of an embodiment of a thigh holster.

As shown in FIG. 6, the pocket 506 can optionally include one or more additional layers. In some embodiments, the pocket 506 can include one or more layers of a moisture barrier 518 to help prevent moisture, perspiration, and/or body oils from the user from reaching the contents of the pocket 506. The moisture barrier 518 may comprise a water resistant fabric, as described in more detail with respect to FIG. 1 above. In an embodiment, the moisture barrier 518 can comprise a material formed from PUL. The moisture barrier 518 can be included as one or more layers on and/or within the pocket 506. In an embodiment, the moisture barrier 518 can be used to line the pocket 506 with a layer being connected to the base layer 502 as well as a layer being connected to the stretchable fabric 508. For example, a single piece of the material forming the moisture barrier 518 can be folded in half and stitched to the sides and/or the bottom of the pocket, thereby lining the pocket 506 with an opening at the top. In some embodiments, the moisture barrier 518 may only be present between the interior of the pocket 506 and the leg of the user. For example, the moisture barrier 518 may be coupled to one or more sides of the base layer 502 to prevent or limit water or oils from the user from reaching the contents of the pocket 506.

Similar to the holster described with respect to FIG. 2, an optional finish layer 530 can be disposed over the base layer 502 and outer pocket assembly 509. For example, a finish layer 530 can be disposed over the outer surface of the thigh holster 500 to provide a finished appearance, limit friction between the thigh holster 500 and any outer clothing layers, and/or to provide additional tension in the thigh holster 500 during use. The finish layer 530 can be a solid layer or an open weave (e.g., a lace). In an embodiment, the finish layer 530 can comprise a stretchable material such as stretch lace. The optional finish layer 530 can have a width that is substantially the same as the width 503 of the base layer 502. In some embodiments, the finish layer 530 can be slightly wider than the width 503 of the base layer 502 to allow the base layer 502 and pocket 506 to be entirely covered. The finish layer 530 can be attached at one or more points to the base layer 502 and/or the pocket 506, for example, stitched at the ends and/or along the top and/or bottom of the thigh holster 500.

As shown in FIG. 6, the base layer 502 can optionally have support structures such as boning 128 at one or more points to provide additional stiffness and resistance to rolling during use. The support structures can include any of those described above with respect to the holster 100, and the support structures may be used in any of the ways described above.

In an embodiment, an optional pocket closure 519 may be used to secure the top opening of the pocket 506. The pocket closure 519 may include any of those pocket closure(s) described herein (e.g., any of the pocket closures 119 described with respect to FIG. 2A). In an embodiment, the pocket closure 519 may include a retention strap 520 that may be optionally used for securing the items in the pocket 506. The retention strap 520 can be constructed in the same or a similar way as described above. For example, the retention strap 520 may be stitched or otherwise connected to the base layer 502. A connection member on the retention strap 520 can be configured to engage a corresponding coupling member on the outer surface of the pocket and provide a retention force. Additional pocket closures 519 may also be used. In an embodiment, the pocket closure 519 may comprise a hidden closure to secure the opening of the pocket 506. For example, a zipper may be placed across the top of the pocket 506 to allow various items such as money, credit cards, or the like to be securely stored within the pocket 506. In some embodiments, a hook and loop type pocket closure 519 may be used to secure the opening of the pocket 506. A hidden closure may be useful to retain various valuables on the body of the user in a concealed manner when the thigh holster 500 is designed for valuables that can fit completely within the pocket 506. For example, the thigh holster 500 may be used to store money, a passport, credit cards, etc., and the hidden closure can be used to secure the opening of the pocket 506.

The thigh holster can be retained about the leg of a user based on tension within the thigh holster 500. Additional support structures can be used to aid in retaining the thigh holster 500 in position. For example, a garter belt 527, garters, suspenders 526, and/or any other support structures can be used. A garter belt 527 generally comprises a belt or other material strip that is worn about the waist. One or more suspenders 526 or support strips are attached to the garter belt 527 and to the thigh holster 500 using any of a variety of connection mechanisms 529. For example, the suspenders 526 can be stitched to the thigh holster 500, or alternatively, a releasable connection such as a clip can be used to couple the suspenders 526 to the thigh holster 500. The suspenders 526 can be adjustable to allow for the fit and length to be adjusted to an individual's dimensions and positioning of the thigh holster 500 on the leg. The connection between the suspenders 526 and the garter belt 527 may provide at least a portion of the support to retain the thigh holster 500 in position about the leg during use.

The various materials making up the thigh holster 500 can be selected to provide the look and feel of the thigh holster 500 based on the customer preferences as well the intended use. For example, the materials can be provided in their natural colors, or any number of color combinations can be selected. For example, the materials can be selected to provide a variety of colors and/or color combinations including, but not limited to, nude, black, white, pink, red, or any combination thereof.

Figure 7:
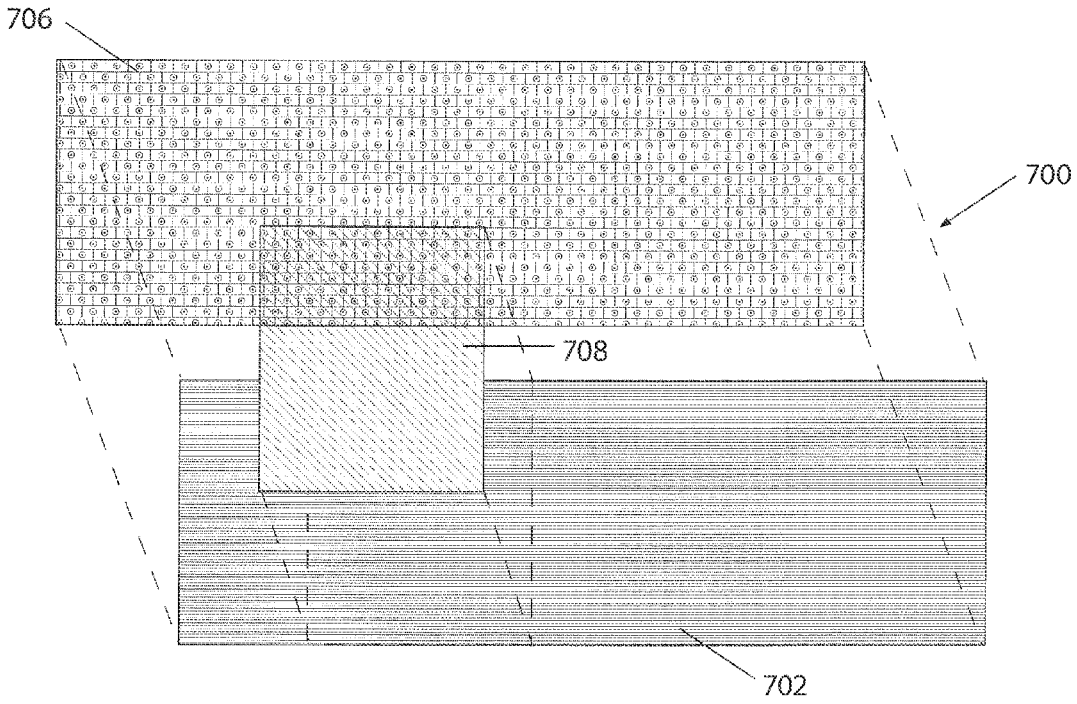
FIG. 7 illustrates a schematic layout of an embodiment of a lace thigh holster.

The thigh holster may also comprise additional designs. In an embodiment as shown in FIG. 7, the thigh holster 700 may be formed from an open weave material such as a stretch lace. In this embodiment, the base layer 702 may be formed entirely from stretch lace. A non-slip material can be disposed on all or a substantial portion of an inside surface of the base layer 702. The pocket 706 can be constructed using stretch lace for the outer pocket layer 708. The resulting pocket 706 can have a relatively open construction to allow airflow into the pocket 706. An all-lace thigh holster 700 may be useful for holding a lightweight handgun and/or other lightweight items such as knives, money, credit cards, passport, ID, cell phones, and the like. Any of the optional support structures such as a garter belt and suspenders can be used to further support the all-lace holster in the event an item is placed in the pocket 706 that may otherwise cause the thigh holster 700 to move or slip during use. In use, the holster 700 may be slipped into position on the leg and retained in position based on tension in the holster 700 and the friction created by the optional non-slip strip of material.

Figure 8:
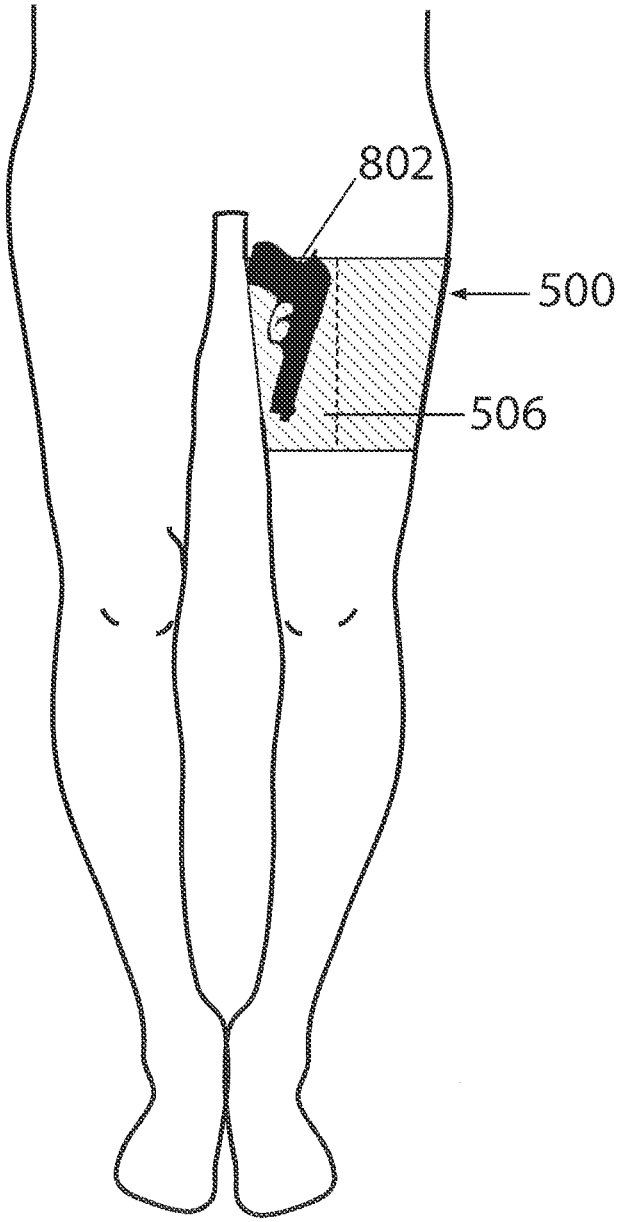
FIG. 8 illustrates an embodiment of the placement of a thigh holster on a leg.

Referring to FIGS. 5A-8, the user may place the thigh holster 500 described above around the right or left leg, where the thigh holster 500 can be configured to be worn on a specific leg. Since the thigh holster 500 forms a continuous band of material, the holster 500 can be slipped into position on the leg by inserting the corresponding foot in the interior of the holster 500 and pulling the holster 500 into position. Once disposed about the leg, the thigh holster 500 may be adjusted as desired. If a garter belt 527 and/or suspenders 526 are used, these may be positioned on the user and appropriately coupled to the thigh holster 500. When worn about the leg, the stretchable fabric forming the base layer 502 creates a tension about the leg of the user that holds the holster 500 in position. The thigh holster 500 may be designed to fit between the knee and hip as shown in FIG. 8. In general, the pocket 506 can be disposed on the interior of the leg. In some embodiments, other rotational positions about the leg can also be used, and in some embodiments, the thigh holster 500 may be designed to fit below the knee.

A weapon 802 such as a handgun, may be disposed within the pocket 506. The handgun may be positioned within the pocket 506 in any configuration, and a portion of the weapon 802 may extend out of the pocket 506. However, the majority of the weapon 802 may be within the pocket 506 and concealed by the front of the pocket 506. For example, a handgun may be positioned in the pocket 506 with at least a portion of the barrel within the pocket 506. A portion of the handgun 802 near the hammer and/or the grip may extend beyond the upper edge of the pocket 506 and thereby protrude out of the pocket 506. Other suitable positions of the weapon 802 in the pocket 506 may be used. For handguns, it is generally desired to position the gun in the pocket 506 to allow the weapon 802 to be drawn with the barrel pointed away from the body and/or leg of the user. In various positions, any portion of the handgun protruding from the pocket 506 may be concealed by other body parts and/or an outer layer of clothing. If an optional retention strap 520 is present, the retention strap 520 may be secured in place over the weapon 802 to further retain the weapon 802 within the pocket 506. An outer garment such as pants, shorts, skirt, dress, etc. may be placed over the thigh holster 500 to further conceal the thigh holster 500, the weapon 802 within the pocket 506, and any portion of the weapon 802 protruding from the pocket 506. The weapon 802 may then be carried by the user in the pocket 506 during normal daily activities without providing an outward indication of the presence of the weapon 802 on the user.

During use, the tension in the thigh holster 500 resulting from the stretchability of the base layer 502 and/or outer pocket assembly 509 can be used to retain the items such as a weapon 802 within the pocket 506. In general, the tension and stretching of the base layer 502 may create a tension between the sides of the pocket 506. The tension may then be present across the portion of the base layer 502 forming the back of the pocket 502 as well as across the entire face of the outer pocket assembly 509. When the outer pocket assembly 509 comprises a stretchable material, the outer pocket assembly 509 may also stretch when the thigh holster 500 is worn to provide tension across the pocket 506. The tension across the pocket 506 can create a closure force on the pocket 506. When an item is disposed within the pocket 506, the tension and resulting closure force can aid in retaining the item within the pocket 506. For example, the contact of the pocket material with the item can create a friction force between the pocket material and the item, and the tension across the pocket 506 can increase this friction force. The selection of materials that are in contact with the items in the pocket 506 can be based, at least in part, on the amount of friction between the items in the pocket 506 and materials in contact with the item. The closure force can also cause the material at the top of the pocket 506 to be biased towards a closed position. This biasing force can aid in at least partially closing the pocket 506, which may partially close around the item such as the weapon 802 (e.g., a handgun).

The thigh holster described herein generally results in the formation of a pocket 506, which may be water resistant, that is concealed from view. While generally described as being designed and holding a weapon 802 such as a handgun, such a concealed pocket design may be used to retain various types of valuables on the body of the user in a concealed manner. For example, the thigh holster 500 may be used to store money, a passport, credit cards, a mobile phone, etc. When designed for valuables that can fit completely within the pocket 506, the thigh holster 500 may comprise a pocket closure 519 to close the opening of the pocket 506. For example, a zipper may be placed across the top of the pocket 506 to allow money to be securely stored within the pocket 506. Once the items are placed in the pocket 506, the pocket closure 519 can then be used to further retain the items in the pocket 506 during use.

In addition to the holsters described above, an ankle holster 900 can be used to provide a pocket 906 about an ankle and/or lower leg of a user that can retain a weapon or various other items. In an embodiment as shown in FIGS.

9A, 9B, and 10, an ankle holster 900 can be configured to selectively secure a weapon about the ankle or lower leg of a person. The ankle holster 900 can include a base layer 902 of material having a pocket 906 formed thereon for receiving an item such as a handgun. The pocket 906 can be formed by coupling a pocket assembly 909 to the base layer 902 of material. The pocket assembly 909 can comprise an inner layer 930 comprising a layer of stretchable material, a structural material layer 934, and an outer layer 932 coupled to the inner layer 930 and retaining the structural material 934 between the inner and outer layers 930, 932. The structural material 934 can be used to protect the ankle and lower leg from any point forces or pressure points and the potential resulting discomfort as a result of the contents of the pocket 906 pressing on the user (e.g., pressing on the ankle bone of the user). The pocket assembly 909 can be coupled to an interior of the base layer 902 to form the pocket 906. While described below as being disposed about the ankle of a user, the ankle holster 900 may also be worn above the ankle and below the knee.

The base layer 902 of the ankle holster 900 can be similar to the base layers described above with respect to the corset holster and the thigh holster. The base layer 902 can comprise a number of materials. Similar to the holsters described above with respect to the holster of FIGS. 1 and 2 and the thigh holsters of FIGS. 5A, 5B, and 6, the ankle holster 900 is maintained about the ankle of the user based on tension, allowing for any stretchable fabric or material to be used for the base layer 902. The base layer 902 may comprise any of the stretchable materials described above. In an embodiment, the stretchable material forming the base layer 902 can include, but is not limited to, corset elastic or any of the other materials described above (e.g., spandex).

The base layer 902 can have a length 905 that is selected based on the dimensions of the user's ankle and/or lower leg. The width 903 of the base layer 902 can be selected based on the desired width 953 of the pocket 906. In some embodiments, the width 903 of the base layer 902 may be uniform about the circumference of the ankle holster 900. In an embodiment, the base layer 902 may be at least about 4 inches, at least about 5 inches, or at least about 6 inches wide 903. In general, the base layer 902 may be less than about 10 inches, or alternatively less than about 9 inches wide 903 to account for the expected location at which the ankle holster 900 may be worn about the ankle and/or lower leg.

Figure 9A:
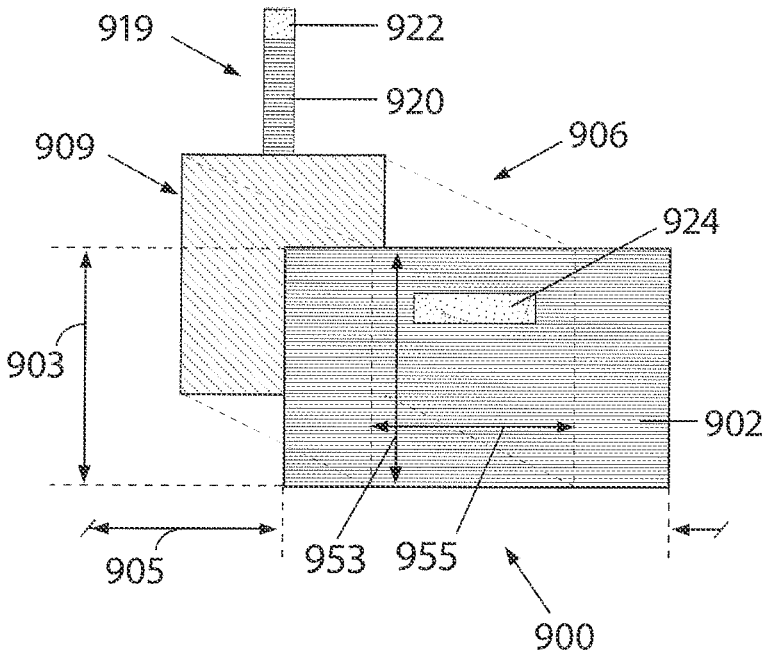
FIG. 9A illustrates a schematic layout of an embodiment of an ankle holster.
Figure 9B:
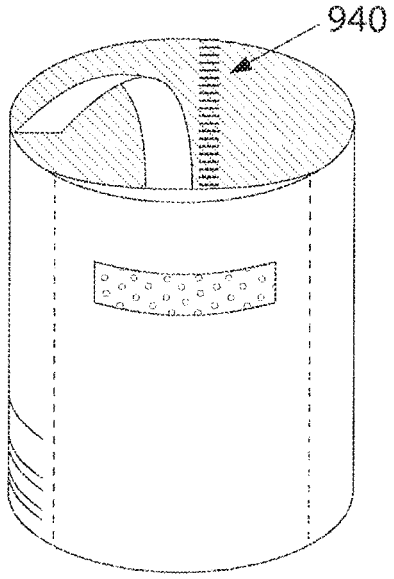
FIG. 9B illustrates a schematic perspective view of an embodiment of an ankle holster.
Figure 10:
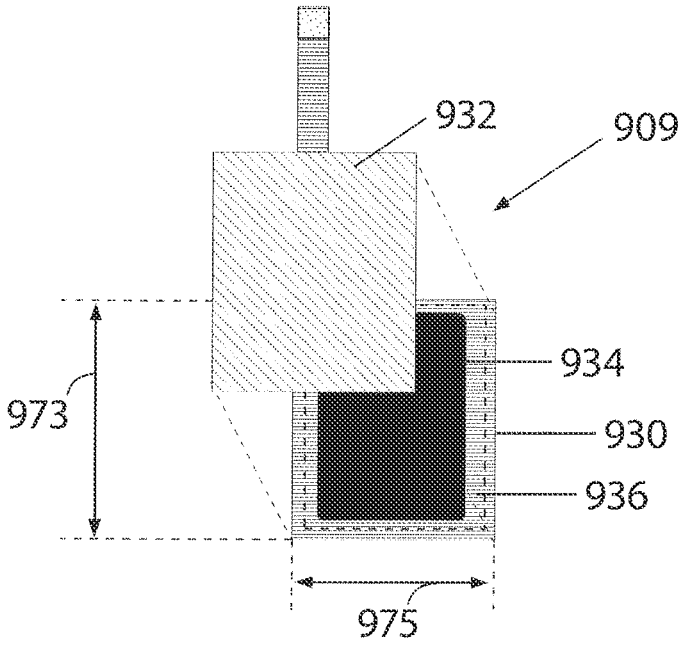
FIG. 10 illustrates a schematic layout of an embodiment of a pocket assembly for an ankle holster.

In an embodiment, the ends of the base layer 902 can be coupled together to form a continuous band or loop for the base layer 902 (e.g., as shown in FIG. 9B). Various connection methods can be used to create the connection 940 between the ends of the base layer 902. In an embodiment, the ends of the base layer 902 can be stitched together to form a single band of material. For example, the ends can be finished using a serger to create a flat connector (e.g. seam) 940 that lies flat against the ankle. The use of a flat seam can avoid pressure points that can lead to discomfort for the user. In some embodiments, the base layer 902 can also comprise a closure mechanism including, but not limited to, any of those closure mechanisms described above (e.g., as described in more detail herein). For example, the base layer can comprise a hook and loop type closure mechanism to allow the fit and tension of the ankle holster 900 about the ankle to be adjusted by the user.

The pocket 906 can be formed by coupling a pocket assembly 909 to the base layer 902. The use of a pocket 906 near the ankle can cause pressure on the ankle bone. For example, a handgun placed in the pocket 906 can allow a hard metal or polymer surface or edge to press on the ankle bone, which can cause discomfort to the user. In order to spread out the pressure on the ankle or lower leg, the pocket assembly 909 can comprise an optional structural material layer 934. The structural material 934 may be stiffer and harder than the material forming the remainder of the pocket assembly 909. The structural material 934 can resist deformation when a force is applied by an object within the pocket 906 and thereby limit or reduce the pressure on the ankle. Various plastics (e.g., thermoplastics, thermosetting plastics, etc.) may be used for the structural material 934 including, but not limited to, acrylics, polyamides (e.g., nylon), polyethylene, polypropylene, polystyrene, polyvinyl chlorides, fluoropolymers, polyurethanes, natural and synthetic rubbers, and any combinations thereof. In an embodiment, the structural material 934 can comprise a thermoplastic, for example a thermoplastic such as Kydex thermoplastic (e.g., an acrylic-polyvinyl chloride material).

The structural layer 934 can be retained in position between the interior of the pocket 906 and the ankle using additional material layers. In an embodiment, the pocket assembly 909 can include an inner material layer 930 that can be coupled to the structural material layer 934. The inner material layer 930 can comprise a stretchable fabric including any of those used to form the base layer 902 (e.g., a corset elastic). The inner material layer 930 can be formed from the same material as the base layer 902 or a different material. The structural layer 934 may be coupled to the inner material layer 930 using, for example, stitching, an adhesive, or the like.

The pocket assembly 909 can also include an outer layer 932 that is coupled to the inner material layer 930 and/or the structural layer 934. In an embodiment, the outer layer 932 can comprise any of the materials used to form the base layer 902 and/or the inner material layer 930. For example, the outer layer 932 can generally comprise a stretchable material such as corset elastic. The outer layer 932 can be formed from the same material as the base layer 902 and/or the inner material layer 930, or a different material can be used. The use of the same material for the base layer 902 and the inner material layer 930 and/or the outer layers 932 may allow for a uniform elastic construction of the ankle holster 900. The outer layer 932 may be coupled to the inner material layer 930 and/or the structural layer 934 using, for example, stitching, an adhesive, or the like. The resulting pocket assembly 909 can then include the layer of structural material 934 retained between the inner material layer 930 and the outer layer 932. The pocket assembly 909 can have a width 973 that substantially matches the width 903 of the base layer 902, thereby creating a pocket 906 extending substantially the width 903 of the base layer 902. The length 975 of the pocket assembly 909 can be selected to provide a pocket 906 suitable for holding a desired weapon or other item. In an embodiment, the pocket assembly 909 may be at least about 3 inches, at least about 4 inches, or at least about 5 inches in length 975, and may generally be less than about 8 inches in length 975.

In some embodiments, an optional padding layer 936 may also be included in the pocket assembly 909. The padding layer 936 may be useful in further padding the ankle and/or lower leg between the structural material layer 934 and the ankle and/or lower leg. The padding layer 936 may reduce and/or spread out the force applied to the user when the item is placed in the pocket 906. The padding layer 936 can include any of the padding materials described herein (e.g., bra padding, neoprene, etc.). The padding layer 936 can be included next to the structural material layer 934 between the inner layer 930 and the outer layer 932. The padding layer 936 may be disposed on the side of the structural material layer 934 that may allow the padding layer 936 to be positioned between the structural material layer 934 and the ankle during use. The padding layer 936 can be retained in position by being coupled to the inner layer 930 and/or out layer 932, or by being enclosed by the coupling between the inner layer 930 and outer layer 932.

The pocket assembly 909 can be formed by stitching the pocket assembly 909 to the base layer 902. The pocket assembly 909 can be attached to an interior of the base layer 902 such that the base layer 902 forms the outer surface of the pocket 906, and the pocket assembly 909 forms the interior surface of the pocket 906 that contacts the ankle or lower leg. The pocket assembly 909 can be coupled to the base layer 902 (e.g., stitched, etc.) on the bottom, left, and right to form a pocket 906 having an opening at the top. The length 955 of the pocket 906 can be selected to provide a pocket 906 suitable for holding a desired handgun or other item. By creating the pocket 906 in this fashion, the pocket 906 can accommodate a variety of guns or items rather than being gun or item specific. In some embodiments, the pocket 906 can be constructed to accommodate larger or smaller guns and/or additional items (ammunition clips, money, identification, wallets, cell phones, etc.).

An optional pocket closure 919 may be used to secure the top opening of the pocket 906. The pocket closure 919 may include any of those pocket closures described herein. In an embodiment, the pocket closure 919 may include a retention strap 920 that may be optionally used for securing the items in the pocket 906. The retention strap 920 can be constructed in the same or a similar way as described above. For example, the retention strap 920 may be stitched or otherwise connected to the pocket assembly 909 and/or base layer 902. For example, the retention strap 920 can be inserted into the top of the pocket assembly 909 when the inner and outer layers 930, 932 are coupled together. A corresponding latch or connection member can then be coupled to the base layer 902 to allow the retention strap 920 to be coupled over the opening of the pocket 906. For example, a hook and loop type attachment structure 922 can attached to the retention strap 920 and a corresponding hook or loop type structure 924 attached to the base layer 902.

Additional pocket closures 919 may also be used. In an embodiment, the pocket closure 919 may comprise a hidden closure to secure the opening of the pocket 906. For example, a zipper may be placed across the top of the pocket 906 to allow various items such as money, credit cards, and the like to be securely stored within the pocket 906. In some embodiments, a hook and loop type pocket closure may be used to secure the opening of the pocket. For example, the hook and loop type pocket closure can be disposed on opposite sides of the interior edges of the pocket. A hidden closure may be useful to retain various valuables on the body of the user in a concealed manner when the ankle holster 900 is designed for valuables that can fit completely within the pocket 906. For example, the ankle holster 900 may be used to store money, a passport, credit cards, etc., and the hidden closure can be used to secure the opening of the pocket 906.

The pocket 906 can optionally include one or more additional layers. In some embodiments, the pocket 906 can include one or more layers of a moisture barrier to help prevent moisture, perspiration, and/or body oils from the user from reaching the contents of the pocket 906. The moisture barrier may comprise a water resistant fabric, as described in more detail herein. In an embodiment, the moisture barrier can comprise a material formed from PUL.

Similar to the holsters described above, an optional finish layer can be disposed over the base layer 902 and outer pocket assembly 909. For example, a material layer can be disposed over the outer surface of the ankle holster 900 to provide a finished appearance, limit friction between the ankle holster 900 and any outer clothing layers, and/or to provide additional tension in the ankle holster 900 during use. The finish layer can be a solid layer or an open weave (e.g., a lace). In an embodiment, the finish layer can comprise a stretchable material such as stretch lace.

The optional finish layer can have a width that is substantially the same as the width of the base layer 902. In some embodiments, the finish layer can be slightly wider than the width of the base layer 902 to allow the base layer 902 and pocket 906 to be entirely covered. The finish layer can be attached at one or more points to the base layer 902 and/or the pocket 906, for example, stitched at the ends and/or along the top and/or bottom of the ankle holster 900.

The various materials making up the ankle holster 900 can be selected to provide the look and feel of the ankle holster 900 based on the customer preferences as well the intended use. For example, the materials can be provided in their natural colors, or any number of color combinations can be selected. For example, the materials can be selected to provide a variety of colors and/or color combinations including, but not limited to, nude, black, white, pink, red, or any combination thereof.

Figure 11:
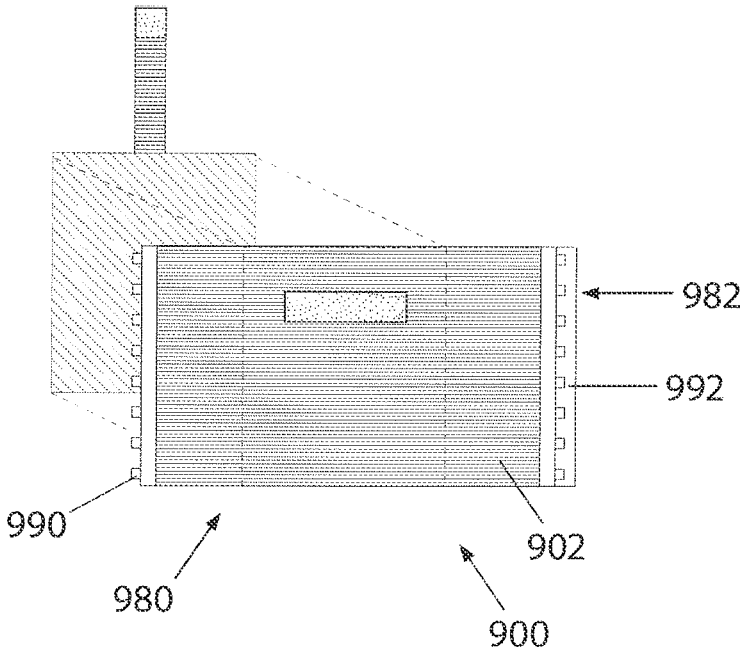
FIG. 11 illustrates another schematic layout of another embodiment of a pocket assembly for an ankle holster.

In an embodiment shown in FIG. 11, the ends of the base layer 902 can be coupled together using a lingerie type closure having hooks 990 and corresponding eyelets 992. In this embodiment, a first attachment member 980 may comprise one or more rows of hooks 990. For example, the first attachment member 980 can comprise one, two, three, four, or more rows of hooks 990. Each row of hooks 990 can comprise a plurality of hooks, for example, each row of hooks can comprise between about 2 and 10 hooks, alternatively between about 3 and 6 hooks. The second attachment structure 982 can comprise a row of eyelets 992 configured to engage one of the rows of hooks 990. The number of hooks in each row can correspond to the number of eyelets in each row and have a corresponding spacing. The plurality of rows of eyelets allows for a selective adjustment to the size and tension of the holster 900 when the hooks 990 are engaged with one of the rows of eyelets 992. An optional portion of the fabric may extend from beyond the second attachment structure 982 to provide a smooth layer between the closure mechanism and the skin of the user to help reduce any undesired irritation to the user.

In the embodiment shown in FIG. 11, a single row of eyelets 992 may be used with the single row of hooks 990. While the use of a single row of eyelets may provide a relatively fixed engagement, the fit of the ankle holster 900 can be designed so that the connection of the hooks to the eyelets only requires a relatively small amount of stretching of the elastic. The resulting tension may be selected to be comfortable to the user during use without constricting the ankle. Further, the use of a selectively engageable attachment to connect the ends of the base layer 902 may allow the ankle holster 900 to be placed on and/or removed from the ankle without requiring that the ankle holster 900 be slipped over the foot. This may be useful for users having different body shapes (e.g., large feet, ankle bones, legs, etc.). While described as a lingerie type attachment, other selectively engageable attachment structures can also be used (e.g., hook and loop, zipper, etc.).

In use, the ankle holster 900 can be slipped onto the foot much like a sock is slipped on, and/or the ankle holster 900 can be placed on the ankle/lower leg where the ends can be coupled to retain the ankle holster 900 about the ankle/lower leg. In some embodiments, the absence of a closure allows a more secure fit on the ankle due to increased stretch of the elastic, reduces skin irritation caused by closure mechanisms, and reduces the potential for clothing snags caused by closing mechanisms. In other embodiments, the use of a closure allows the ankle holster to be more easily placed on the ankle without being required to stretch over the foot of the user.

Figure 12:
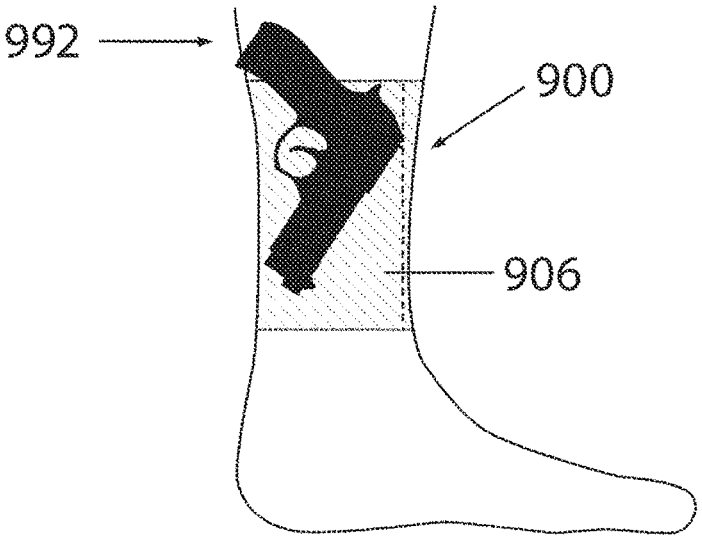
FIG. 12 illustrates an embodiment of the placement of an ankle holster on a lower leg.

As shown in FIG. 12, a weapon 992 such as a handgun, may be disposed within the pocket 906. The handgun may be positioned within the pocket 906 in any configuration, and a portion of the weapon 992 may extend out of the pocket 906. For example, a handgun may be positioned in the pocket 906 with at least a portion of the barrel within the pocket 906. A portion of the handgun near the hammer and/or the grip may extend beyond the upper edge of the pocket 906 and thereby protrude out of the pocket 906. Other suitable positions of the weapon 992 in the pocket 906 may be used. If an optional pocket closure 919 is present, the pocket closure 919 may be secured in place over the weapon 992 to further retain the weapon 992 within the pocket 906. An outer garment such as pants, socks, boots, etc. may be placed over the ankle holster 900 to further conceal the holster 900, the weapon 992 within the pocket 906, and any portion of the weapon 992 protruding from the pocket 906. The weapon 992 may then be carried by the user in the pocket 906 during normal daily activities without providing an outward indication of the presence of the weapon 992 on the user.

The construction of the pocket 906 comprising an elastic pocket assembly on an elastic band can reduce bulk yet hold the handgun securely in place. The structural material layer 934 may reduce the discomfort associated with the weapon 992 or other item resting against the ankle and/or shin bone. As shown in FIG. 12, the ankle holster 900 can be worn on either ankle or on the inside or outside of the leg, allowing for both right- and left-handed carry. The pocket 906 accommodates a variety of handguns, rather than a specific model. The open pocket 906 also allows the wearer to "cant" or position the gun in such a way that if closely follows the contour of the leg, further reducing the outward indication of the presence of the weapon 992 on the user. If an optional retention strap 920 is desired, the strap 920 may be secured in place over the weapon 992 to further retain the weapon 992 within the pocket 906.

During use, the tension in the ankle holster 900 resulting from the stretchability of the base layer 902 and/or the pocket assembly 909 can be used to retain the items such as a weapon 992 within the pocket 906. In general, the tension and stretching of the base layer 902 may create a tension between the sides of the pocket 906. The tension may then be present across the portion of the base layer 902 forming the outer surface of the pocket 906. When the pocket assembly 909 comprises a stretchable material, the pocket assembly 909 may also stretch when the ankle holster 900 is worn to provide tension across the pocket 906. The tension across the pocket 906 can create a closure force on the pocket 906. When an item is disposed within the pocket 906, the tension and resulting closure force can aid in retaining the item within the pocket 906. For example, the contact of the pocket 906 material with the item can create a friction force between the pocket material and the item, and the tension across the pocket 906 can increase this friction force. The selection of materials that are in contact with the items in the pocket 906 can be based, at least in part, on the amount of friction between the items in the pocket 906 and materials in contact with the item. The closure force can also cause the material at the top of the pocket 906 to be biased towards a closed position. This biasing force can aid in at least partially closing the pocket 906, which may partially close around the item such as the weapon 992 (e.g., a handgun).

While generally described as being designed and holding a handgun, such a concealed pocket design may be used to retain various types of valuables on the ankle and/or lower leg of the user in a concealed manner. For example, the ankle holster 900 may be used to store money, a passport, credit cards, a mobile phone, etc. When designed for valuables that can fit completely within the pocket, the ankle holster 900 may comprise a closure mechanism 919 to close the opening of the pocket 906. For example, a zipper may be placed across the top of the pocket 906 to allow money to be securely stored within the pocket 906. Once the items are placed in the pocket, the closure mechanism 919 can then be used to further retain the items in the pocket 906 during use.

Having described the apparatus, devices, and methods herein, various embodiments can include, but are not limited to:

In a first embodiment, an apparatus for selectively securing a weapon about the torso of a human comprises a base layer comprising a band of elastic configured to be disposed about the torso, a closure mechanism configured to retain the base layer about the torso, and a pocket comprising a padding layer coupled to the base layer on three sides. In a second embodiment, the base layer of the first embodiment may comprise corset elastic. In a third embodiment, the corset elastic of the second embodiment may be configured to be worn against the skin. In a fourth embodiment, the apparatus of any of the first to third embodiments may also include a water resistant layer lining the pocket. In a fifth embodiment, the water resistant layer of the fourth embodiment may be configured to resist the entrance of perspiration from entering the pocket. In a sixth embodiment, the water resistant layer of the fourth or fifth embodiment may comprise PUL fabric. In a seventh embodiment, the pocket of any of the first to sixth embodiments may also include an elastic fabric layer disposed over the padding layer and coupled to the base layer. In an eighth embodiment, the padding layer of any of the first to seventh embodiments may comprise a double layer of padding material. In a ninth embodiment, the apparatus of any of the first to eighth embodiments may also include a layer of lace fabric disposed over the base layer and the pocket. In a tenth embodiment, the closure mechanism of any of the first to ninth embodiments may comprise lingerie closures. In an eleventh embodiment, the lingerie closures of the tenth embodiment may comprise hook and eye closures. In a twelfth embodiment, the closure mechanism of the eleventh embodiment may comprise a plurality of rows of eyes. In a thirteenth embodiment, the pocket of any of the first to twelfth embodiments may be rectangular. In a fourteenth embodiment, the pocket of any of the first to twelfth embodiments may be triangular. In a fifteenth embodiment, the pocket of any of the first to fourteenth embodiments may be configured to receive a weapon. In a sixteenth embodiment, the apparatus of any of the first to fifteenth embodiments may also include a retaining strap. The retaining strap may be coupled to one of the base layer or the pocket, and the retaining strap may be configured to engage both the base layer and the pocket when a weapon is disposed within the pocket. In a seventeenth embodiment, the apparatus of any of the first to sixteenth embodiments may also include a shoulder strap. In an eighteenth embodiment, the closure mechanism of any of the first to ninth embodiments may comprise at least one of a hook and loop fastener system or a grommet and string fastener system. In a nineteenth embodiment, the apparatus of any of the first to eighteenth embodiments may also include a second closure mechanism disposed along the top of the pocket, and the second closure mechanism may be configured to selectively provide access to the interior of the pocket.

In a twentieth embodiment, a method of carrying a weapon comprises retaining a corset about a body of a user using tension, disposing a handgun within the pocket, and retaining the handgun within the pocket based on the tension of the corset. The corset comprises, a base layer comprising a band of elastic configured to be disposed about the torso, a closure mechanism configured to retain the base layer about the torso, and a pocket comprising a padding layer coupled to the base layer on three sides. In a twenty first embodiment, at least a portion of the handgun of the twentieth embodiment may be disposed within the pocket. In a twenty second embodiment, the handgun of the twentieth or twenty first embodiment may be disposed completely within the pocket. In a twenty third embodiment, retaining the corset about the torso of a user in any of the twentieth to twenty second embodiments may also include retaining the corset about the torso based on contacting a non-slip polymer strip on the base layer with the skin of the user. In a twenty fourth embodiment, the method of any of the twentieth to twenty third embodiments may also include repelling water from the pocket using a water resistant lining within the pocket. In a twenty fifth embodiment, the method of any of the twentieth to twenty fourth embodiments may also include breaking up at least a portion of an outline of the handgun using the padding. In a twenty sixth embodiment, the corset of any of the twentieth to twenty fifth embodiments may also include a retaining strap, and the retaining strap may be coupled to one of the base layer or the pocket. The method may also include engaging the retaining strap with both the base layer and the pocket, and retaining the handgun within the pocket based at least in part on the retaining strap. In a twenty seventh embodiment, the corset of any of the twentieth to twenty sixth embodiments may be disposed about one of the torso of the user or the waist of the user. In a twenty eighth embodiment, the pocket of any of the twentieth to twenty seventh embodiments may be aligned under the bra line of a female. In a twenty ninth embodiment, the pocket of any of the twentieth to twenty seventh embodiments may be aligned under the arm of the user. In a thirtieth embodiment, the pocket of any of the twentieth to twenty seventh embodiments may be aligned to the back of a user. In a thirty first embodiment, the method of any of the twentieth to twenty seventh embodiments may also include disposing an outer garment over the corset.

In a thirty second embodiment an apparatus for selectively securing a weapon about a leg of a human comprises a base layer comprising a band of elastic configured to be disposed about the leg, a pocket comprising a layer of fabric coupled to the base layer on three sides, and an outer lace layer disposed over the base layer and pocket. The base layer is configured to provide a continuous layer about the leg. In a thirty third embodiment, the base layer of the thirty second embodiment may comprise corset elastic. In a thirty fourth embodiment, the corset elastic of the thirty third embodiment may be configured to be worn against the skin. In a thirty fifth embodiment, the apparatus of any of the thirty second to thirty fourth embodiments may also include a non-slip polymer strip disposed along an inside edge of the base layer. In a thirty sixth embodiment, the apparatus of any of the thirty second to thirty fifth embodiments may also include a non-slip polymer layer disposed on substantially the entire inside surface of the base layer. In a thirty seventh embodiment, the apparatus of any of the thirty second to thirty sixth embodiments may also include a water resistant layer lining the pocket. In a thirty eighth embodiment, the water resistant layer of the thirty seventh embodiment may be configured to resist the entrance of perspiration from entering the pocket. In a thirty ninth embodiment, the water resistant layer of the thirty seventh or thirty eighth embodiment may comprise a PUL fabric. In a fortieth embodiment, the pocket of any of the thirty second to thirty ninth embodiments may be rectangular. In a forty first embodiment, the pocket of any of the thirty second to thirty ninth embodiments may be triangular. In a forty second embodiment, the pocket of any of the thirty second to forty first embodiments may be configured to receive a weapon. In a forty third embodiment, the apparatus of any of the thirty second to forty second embodiments may also include a retaining strap, and the retaining strap may be coupled to one of the base layer or the pocket. The retaining strap may be configured to engage both the base layer and the pocket when a weapon is disposed within the pocket. In a forty fourth embodiment, the apparatus of any of the thirty second to forty third embodiments may also include a support strap coupled to the base layer, and the support strap may be configured to retain the apparatus in position on the leg. In a forty fifth embodiment, the support strap of the forty fourth embodiment may comprise a garter coupled to a garter belt. In a forty sixth embodiment, the apparatus of any of the thirty second to forty fifth embodiments may also include a second closure mechanism disposed along the top of the pocket, and the second closure mechanism may be configured to selectively provide access to the interior of the pocket.

In a forty seventh embodiment, a method of carrying a weapon comprises retaining a holster about a leg of a user using tension, disposing a handgun within the pocket, and retaining the handgun within the pocket based on the tension of the holster. The holster comprises a base layer comprising a band of elastic configured to be disposed about the leg, and a pocket comprising a layer of fabric coupled to the base layer on three sides. In a forty eighth embodiment, the method of the forty seventh embodiment may also include retaining the holster about the leg of the user using a support strap. In a forty ninth embodiment, the support strap of the forty eighth embodiment may comprise a garter coupled to a garter belt. In a fiftieth embodiment, at least a portion of the handgun of any of the forty seventh to forty ninth embodiments may be disposed within the pocket. In a fifty first embodiment, the handgun of any of the forty seventh to fiftieth embodiments may be disposed completely within the pocket. In a fifty second embodiment, retaining the holster about the leg of a user in any of the forty seventh to fifty first embodiments may also include retaining the holster about the leg based on contacting a non-slip polymer strip on the base layer with the skin of the user. In a fifty third embodiment, the method of any of the forty seventh to fifty second embodiments may also include repelling water from the pocket using a water resistant lining within the pocket. In a fifty fourth embodiment, the holster of any of the forty seventh to fifty third embodiments may also include a retaining strap, and the retaining strap may be coupled to one of the base layer or the pocket. The method may also include engaging the retaining strap with both the base layer and the pocket, and retaining the handgun within the pocket based at least in part on the retaining strap. In a fifty fifth embodiment, the pocket of any of the forty seventh to fifty fourth embodiments may be aligned along the inside of the thigh. In a fifty sixth embodiment, the method of any of the forty seventh to fifty fifth embodiments may also include disposing an outer garment over the holster.

In a fifty seventh embodiment, an apparatus for selectively securing a weapon about an ankle of a human comprises an inner pocket backing and an outer band configured to be disposed about the ankle. The inner pocket backing comprises an inner layer comprising a piece of elastic, a structural material piece, and an outer pocket layer. The outer pocket layer is coupled to the base layer, and the structural material piece is disposed between the outer pocket layer and the base layer. The base layer is configured to provide a continuous layer about the ankle, and the inner pocket backing is coupled to an inside of the outer band on three sides to form a pocket. In a fifty eighth embodiment, the outer band of the fifty seventh embodiment comprises corset elastic. In a fifty ninth embodiment, the corset elastic of the fifty eighth embodiment may be configured to be worn against the skin. In a sixtieth embodiment, the apparatus of any of the fifty seventh to fifty ninth embodiments may also include a retention strap coupled between the base layer and the outer pocket layer. In a sixty first embodiment, the apparatus of the sixtieth embodiment may also include a coupling member disposed on the retention strap and an outer surface of the outer band. The retention strap may be configured to selectively engage the outer pocket layer using the coupling member. In a sixty second embodiment, the apparatus of any of the fifty seventh to sixty first embodiments may also include a water resistant layer lining the pocket. In a sixty third embodiment, the water resistant layer of the sixty second embodiment may be configured to resist the entrance of perspiration from entering the pocket. In a sixty fourth embodiment the water resistant layer of the sixty second or sixty third embodiment may comprise PUL fabric. In a sixty fifth embodiment, the apparatus of any of the fifty seventh to sixty fourth embodiments may also include an outer lace layer disposed over the outer band. In a sixty sixth embodiment, the apparatus of any of the fifty seventh to sixty fifth embodiments may also include a closure mechanism configured to selectively open or close the outer band about the ankle. In a sixty seventh embodiment, the apparatus of any of the fifty seventh to sixty sixth embodiments may also include a padding layer. In a sixty eighth embodiment, the padding layer of the sixty seventh embodiment may be disposed on an interior of the outer band. In a sixty ninth embodiment the padding layer of the sixty seventh embodiment may be disposed between the structural material and the inner layer. In a seventieth embodiment, the pocket of any of the fifty seventh to sixty ninth embodiments may be configured to receive a weapon. In a seventy first embodiment, the apparatus of any of the fifty seventh to seventieth embodiments may also include a second closure mechanism disposed along the top of the pocket, and the second closure mechanism may be configured to selectively provide access to the interior of the pocket.

In a seventy second embodiment, a method of carrying a weapon comprises retaining a holster about an ankle of a user, disposing a handgun within the pocket, and retaining the handgun within the pocket based on the tension of the holster. The holster comprises an inner pocket backing and an inner band. The inner pocket backing comprises an inner layer comprising a piece of elastic, a structural material piece, and an outer pocket layer. The outer pocket layer is coupled to the base layer, and the structural material piece is disposed between the outer pocket layer and the base layer. The outer band is configured to be disposed about the ankle, and the base layer is configured to provide a continuous layer about the ankle. The inner pocket backing is coupled to an inside of the outer band on three sides to form a pocket. In a seventy third embodiment, at least a portion of the handgun of the seventy second embodiment may be disposed within the pocket. In a seventy fourth embodiment, the handgun of the seventy second or seventy third embodiment may be disposed completely within the pocket. In a seventy fifth embodiment, the method of any of the seventy second to seventy fourth embodiments may also include repelling water from the pocket using a water resistant lining within the pocket. In a seventy sixth embodiment, the holster of any of the seventy second to seventy fifth embodiments may also include a retaining strap, and the retaining strap is coupled to the inner pocket backing. The method may also include engaging the retaining strap with both the inner pocket backing and the outer band, and retaining the handgun within the pocket based at least in part on the retaining strap. In a seventy seventh embodiment, the method of any of the seventy second to seventy sixth embodiments may also include disposing an outer garment over the holster. In a seventy eighth embodiment, the method of any of the seventy second to seventy seventh embodiments may also include slipping the holster about the ankle of the user. In a seventy ninth embodiment, the method of any of the seventy second to seventy seventh embodiments may also include securing the holster about the ankle of the user using a closure mechanism. In an eightieth embodiment, the method of any of the seventy second to seventy ninth embodiments may also include disposing a non-weapon based item in the pocket.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An apparatus for selectively securing a weapon about the torso of a human, the apparatus comprising:

a base layer comprising a band of elastic configured to be disposed about the torso, wherein the base layer comprises a first end and a second end;

a closure mechanism configured to retain the base layer about the torso and couple the first end to the second end, wherein the base layer has a substantially uniform width about the torso when the closure mechanism couples the first end to the second end;

a pocket comprising a padding layer and an elastic fabric layer coupled to the base layer on three sides, wherein the elastic fabric layer is disposed between the padding layer and an interior of the pocket, wherein the pocket has a width that is less than or equal to the width of the base layer, wherein the pocket is closed along the bottom and has an opening along a top, wherein the opening along the top is substantially aligned with an upper edge of the base layer, and wherein no pocket closure is used to secure the opening along the top of the pocket; and a handgun disposed in the pocket, wherein a barrel and a grip of the handgun are enclosed within the pocket, and wherein the opening is closed around a portion of the handgun near the hammer, rear slide, or rear frame.

2. The apparatus of claim 1, wherein the base layer comprises corset elastic.

3. The apparatus of claim 1, further comprising a water resistant layer lining the pocket.

4. The apparatus of claim 3, wherein the water resistant layer comprises PUL fabric coupled to the base layer and the padding layer on the three sides.

5. The apparatus of claim 1, wherein the closure mechanism comprises lingerie closures.

6. The apparatus of claim 5, wherein the lingerie closures comprise hook and eye closures.

7. The apparatus of claim 1, further comprising a shoulder strap.

8. The apparatus of claim 1, wherein the base layer and the elastic fabric layer are configured to use an elastic response to retain a weapon in the pocket when the base layer is placed in tension.

9. The apparatus of claim 1, wherein the padding layer and the elastic fabric layer are coupled to an exterior of the base layer.

10. An apparatus for selectively securing a weapon about a leg of a human, the apparatus comprising:

a base layer comprising a band of elastic configured to be disposed about the leg, wherein the base layer comprises a continuous loop about the leg;

a rectangular pocket comprising a layer of fabric coupled to the base layer on three sides, wherein the pocket is closed on the three sides and only open along a top of the pocket, wherein the layer of fabric comprises a stretchable material, wherein the layer of fabric comprises the upper edge that is not coupled to the base layer to form the opening, wherein the top of the pocket is substantially aligned with an upper edge of the base layer, and wherein no pocket closure is used to secure the opening along the top of the pocket;

a handgun disposed in the pocket, wherein a barrel and a grip of the handgun are enclosed within the pocket, and wherein the opening is closed around a portion of the handgun near the hammer, rear slide, or rear frame; and an outer lace layer disposed over the base layer and pocket.

11. The apparatus of claim 10, further comprising a non-slip polymer strip disposed along an inside edge of the base layer.

12. The apparatus of claim 10, further comprising a non-slip polymer layer disposed on substantially the entire inside surface of the base layer.

13. The apparatus of claim 10, further comprising a water resistant layer lining the pocket.

14. The apparatus of claim 10, further comprising a support strap coupled to the base layer, wherein the support strap is configured to retain the apparatus in position on the leg.

15. The apparatus of claim 14, wherein the support strap comprises a garter coupled to a garter belt.

16. The apparatus of claim 10, wherein the layer of fabric is coupled to an exterior of the base layer.

17. An apparatus for selectively securing a weapon about an ankle of a human, the apparatus comprising:

an inner pocket backing comprising:

an inner layer comprising a piece of elastic;

a structural material piece;

an outer pocket layer, wherein the outer pocket layer is coupled to the inner layer, and wherein the structural material piece is disposed between the outer pocket layer and the inner layer;

an outer band configured to be disposed about the ankle, and wherein the inner pocket backing is coupled to an inside of the outer band on three sides to form a pocket, wherein an opening of the pocket is aligned along an upper edge of the outer band, and wherein the pocket is closed except for the opening aligned along the upper edge of the outer band, and wherein no pocket closure mechanism is used to secure the opening along a top of the pocket; and a handgun disposed in the pocket, wherein a barrel and a grip of the handgun are enclosed within the pocket, and wherein the opening is closed around a portion of the handgun near the hammer, rear slide, or rear frame.

18. The apparatus of claim 17, wherein the outer band is configured to provide a continuous layer about the ankle.

19. The apparatus of claim 17, further comprising a closure mechanism configured to retain the outer band about the ankle and couple a first end of the outer band to a second end of the outer band.

20. The apparatus of claim 17, wherein the outer band comprises corset elastic.

21. The apparatus of claim 20, wherein the corset elastic is configured to be worn against the skin.

22. The apparatus of claim 17, further comprising a water resistant layer lining the pocket.

23. The apparatus of claim 22, wherein the water resistant layer comprises PUL fabric.

24. The apparatus of claim 17, further comprising a padding layer.

25. The apparatus of claim 24, wherein the padding layer is disposed on an interior of the outer band.

26. The apparatus of claim 24, wherein the padding layer is disposed between the structural material and the inner layer.

27. A method of carrying a weapon, the method comprising:

positioning a holster about a body of a user, wherein the holster comprises:

a base layer comprising a band of elastic configured to be disposed about a torso of the body, a closure mechanism configured to retain the base layer about the torso, and a pocket comprising a padding layer and an elastic fabric layer coupled to the base layer on three sides, wherein the pocket has a width substantially the same as the width of the base layer, and wherein the pocket is closed along a bottom and has an opening at a top, wherein the opening at the top is substantially aligned along an upper edge of the base layer;

tensioning the base layer based on positioning the holster about the body of the user;

tensioning the padding layer and the elastic fabric layer across the width of the pocket based on tensioning the base layer;

biasing the opening of the pocket towards a closed position based on tensioning the padding layer and the elastic fabric layer;

disposing a handgun within the pocket, wherein a barrel and a grip of the handgun are enclosed within the pocket;

closing, at least partially, the opening of the pocket around a portion of the handgun near the hammer, rear slide, or rear frame; and retaining the handgun within the pocket without a pocket closure used along the top of the pocket, wherein retaining the handgun within the pocket is based on the tension between the base layer and the padding and elastic fabric layers and based on the biasing and closing of the opening towards the closed position.

28. The method of claim 27, further comprising breaking up at least a portion of an outline of the handgun using the padding.

29. The method of claim 27, wherein the holster is disposed about one of the torso of the user or the waist of the user.

30. The method of claim 27, wherein the pocket is aligned under the bra line of a female.

* * * * *